US005341164A

United States Patent [19]

Miyazawa et al.

[11] Patent Number: 5,341,164

[45] Date of Patent: Aug. 23, 1994

[54] SOLID INK SUPPLY FOR INK JET

[75] Inventors: Yoshinori Miyazawa; Hiroshi Ishii; Osamu Nakamura; Norihiko Kurashima; Tsuyoshi Kitahara; Hisashi Miyazawa, all of Nagano, Japan

[73] Assignee: Seiko Epson Corporation, Tokyo, Japan

[21] Appl. No.: 62,716

[22] Filed: May 18, 1993

Related U.S. Application Data

[63] Continuation of Ser. No. 641,924, Jan. 16, 1991, abandoned, which is a continuation of Ser. No. 341,773, Apr. 21, 1989, Pat. No. 5,030,972.

[30] Foreign Application Priority Data

| | | | |
|---|---|---|---|
| Apr. 22, 1988 | [JP] | Japan | 63-99420 |
| Apr. 30, 1988 | [JP] | Japan | 63-108722 |
| Jun. 22, 1988 | [JP] | Japan | 63-154143 |
| Jun. 28, 1988 | [JP] | Japan | 63-162325 |
| Oct. 21, 1988 | [JP] | Japan | 63-265297 |
| Nov. 21, 1988 | [JP] | Japan | 63-293883 |
| Nov. 21, 1988 | [JP] | Japan | 63-293994 |

[51] Int. Cl.[5] ..... B41J 2/175; B41J 2/05

[52] U.S. Cl. ..... 347/88

[58] Field of Search ..... 346/1.1, 140 R, 76 PH; 400/120, 126

[56] References Cited

U.S. PATENT DOCUMENTS

| | | | |
|---|---|---|---|
| 4,593,292 | 6/1986 | Lewis . | |
| 4,607,266 | 8/1986 | DeBonte | 346/140 PD |
| 4,609,924 | 9/1986 | De Young | 346/140 |
| 4,636,803 | 1/1987 | Mikalsen | 346/140 |
| 4,682,185 | 7/1987 | Martner . | |

FOREIGN PATENT DOCUMENTS

| | | |
|---|---|---|
| 0178882 | 4/1986 | European Pat. Off. . |
| 0178886 | 4/1986 | European Pat. Off. . |
| 0178889 | 4/1986 | European Pat. Off. . |
| 0181218 | 5/1986 | European Pat. Off. . |
| 60-145855 | 8/1985 | Japan . |
| 60-179259 | 9/1985 | Japan . |
| 62-46650 | 2/1987 | Japan . |
| 62-93133 | 10/1988 | Japan . |

*Primary Examiner*—Mark J. Reinhart

*Attorney, Agent, or Firm*—Cushman, Darby & Cushman

[57] ABSTRACT

An ink jet recording apparatus and method having an ink jet head. The ink jet head includes a housing made of a material having a high coefficient of thermal conductivity, including at least one heat source, and arranged so as to confront a recording medium; an ink holding member arranged inside the housing, the ink holding member transmitting heat generated by the heat source to melt a solid-phase ink put into the housing for holding the molten ink by capillary action; a nozzle formed member being part of the ink holding member and having at least one nozzle orifice arranged so as to confront the recording medium; and a pressure generating member arranged within the ink holding member for generating a pressure which causes ink near the nozzle orifice to jet in the form of ink drops. The ink jet recording method is achieved by the apparatus thus constructed.

24 Claims, 11 Drawing Sheets

SOLID INK SUPPLY FOR INK JET

This is a continuation of application Ser. No. 07/641,924, filed on Jan. 16, 1991, which was abandoned upon the filing hereof which is a Rule 60 continuation of application Ser. No. 07/341,773, filed Apr. 21, 1989 now U.S. Pat. No. 5,030,972.

BACKGROUND OF THE INVENTION

1. Field of the Invention

This invention relates to an ink jet type recording apparatus and method in which ink droplets are jetted to form images on a recording medium such as a recording sheet, and more particularly to an ink jet head and ink supplying apparatus used in an ink jet type recording apparatus and an ink jet recording and ink supplying method in which phase-change ink called "hot-melt ink" is used.

2. Prior Art

With the increasing numbers of computers, fax machines, and copiers in today's society, there is a growing demand for high quality reproduction and print quality on different recording medium. Such demand necessitates the efficient supply of ink to recording apparatus and the development of better means for transferring the ink to a recording medium.

Ink jet heads using a "hot-melt" ink have been disclosed in prior patent applications. U.S. Pat. No. 4,593,292, U.S. Pat. No. 4,631,557 and U.S. Pat. No. 4,609,924 disclose such ink jet heads. These ink jet heads require a plate-shaped heater located in an intermediate ink pool whose purpose is to heat the entire head which is constructed out of materials with high coefficients of thermal conductivity. This heater is typically located outside the walls forming the ink supplying path, resulting in a large thermal loss, and requiring a large capacity heater. Further, reducing the preparation time between the application of voltage and the start of the printing operation is difficult. This interval is the ink preheating period. Another difficulty encountered in these kinds of ink jet heads is that, when the solid-phase ink is changed to a liquid-phase ink, bubbles tend to form in the ink. If the bubbles remain in the ink supplying path, they reduce pressure and the jetting of the ink may not be satisfactory.

Methods of supplying ink to hot-melt ink jet heads which make use of the phase change involving the heating of a solid-phase ink are disclosed in U.S. Pat. No. 4,593,292 and U.S. Pat. No. 4,636,803.

The method of application No. 98546/1986 discloses heating a part of a solid-phase block of ink in order to form liquid-phase ink which is transferred into an ink pooling chamber. The amount of ink supplied is likely to be affected by the ambient temperature. Because the time interval between the start of the ink heating device and the end of the ink supplying operation is lengthy, the ink supplying device, which is located on the carriage, must be operated during printing and kept connected to the ink pooling chamber. Another flaw in this method is that part of the ink liquefied in the ink supplying device but not supplied to the ink pooling chamber resolidifies in the ink supplying device, possibly blocking or partially blocking the operation of the ink pushing cylinder. Another possible obstruction is the portion of the solid-phase ink which is softened and deformed by heating and is located between the liquid and solid portions.

The method of U.S. Pat. No. 4,636,803 discloses allowing solid-phase ink particles or pellets to drop into the ink pooling chamber. However, at high temperatures, it is possible for these particles or pellets to soften and join together, obstructing the ink supplying operation. To overcome this difficulty, solid-phase ink pellets are loaded in the ink supplying device so that they are separated from one another. However, loading the pellets in the ink supplying device is difficult, particularly because volumetric capacity of the ink container is small.

The ink used for an ink jet recording apparatus is a solid at room temperature and, when heated, melts into tacky, liquid-phase ink capable of being jetted in the form of ink droplets. U.S. Pat. Nos. 4,636,803; 4,682,185; and 4,631,557 are examples of related art. U.S. Pat. No. 4,636,803 discloses a device and method in which block-shaped ink, not loaded on the carriage, is supplied at a predetermined rate to the ink jet head. U.S. Pat. No. 4,682,185 discloses a device and method in which bar-shaped solid-phase ink, loaded on the carriage, is fed in to the ink jet head which melts the ink. U.S. Pat. No. 4,631,557 discloses a device and method in which a cartridge containing solid-phase ink is mounted on the ink jet head and the ink is melted by a heater located in the head.

In the conventional ink jet head and ink jet recording method in which the solid-phase ink is liquefied outside the head, it is necessary to provide both a heater for liquefying the ink and one to heat the head and maintain it at high temperature. This arrangement is disadvantageous because it requires an excessive amount of space, consumes more power than is desirable, and costs more to manufacture as an additional circuit is needed for the heater.

Conventional systems where the solid-phase is liquified in the ink jet head, also have disadvantages. First, the ink melting position is set away from the nozzle section for jetting the ink. Also the contact area of the ink melting member is small compared to the volume of the solid-phase ink. Therefore, the space occupied by the components to be heated is large, the amount of heat necessary to heat them is correspondingly large, and the heating time is long. Secondly, the liquid-phase ink deteriorates because it is held in large quantity in the head at high temperature for a prolonged period of time. The last drawback to this method is that the liquid ink may leak out of the ink jet head should the head fall down accidentally.

In other prior art, the ink is supplied to the head through flexible tube-shaped members. The ink in the tube-shaped member is often affected by acceleration and deceleration of the carriage on which the ink jet head is mounted, thus varying the ink pressure in or near a pressure generator. Also, the ink is isolated from the outside air when it is supplied to the pressure generator. The ink is thus affected by the bubbles formed in the ink supplying path, and the ink jet head is therefore not too reliable. In addition, clogging is possible because of the long distance between a filter and the ink jet.

SUMMARY OF THE INVENTION

An object of the present invention is to eliminate the above-mentioned defects with the conventional recording apparatus and method.

Another object of the present invention is to provide an ink jet type recording apparatus and method in which an operation pause time is shorter so that the printing operation can be started quickly and the ink is supplied with ease, the operability is high, the construction is simple, and miniaturization of the device is easy, and the ink is maintained unchanged in characteristic even when used for a long period of time.

A further object of the present invention is to provide an ink jet recording apparatus and method in which the leakage of the liquefied ink in an ink jet head provided in the recording apparatus is prevented at all times no matter what posture the ink jet head assumes.

The foregoing object of the invention has been achieved by the provision of a method of supplying solid-phase ink to a hot-melt ink jet type printing head, which comprises steps of: molding a solid-phase ink into a plurality of solid-phase ink blocks; inserting the solid-phase ink blocks into an ink containing means, and breaking the solid-phase ink blocks thus inserted to separate the solid-phase ink blocks from one another, and supplying the solid-phase ink blocks thus separated to the printing head.

Also, the foregoing object of the invention has been achieved by the provision of an ink jet type recording apparatus and method in which an ink supplying device having an ink container in which solid-phase ink is put and a first heater, and an ink jet head mounted on a carriage moved over a recording medium in a scanning manner and having a second heater and a plurality of nozzles to jet ink droplets are provided, and a part of the ink in the ink supplying device which can be heated by the first heater in the ink container is liquefied by heating and supplied to the head. In the apparatus and method, the quantity of ink in the ink jet head is small, and the solid-phase ink in the ink container provided outside the carriage is liquefied and supplied to the head. Accordingly, the head dimension and thermal capacity, and carriage weight are small, and therefore the heating time is short.

Further, the foregoing objects of the invention have been achieved by the provision of an ink jet type recording device and method which employs: an ink jet head for jetting ink droplets through a plurality of nozzles, the ink jet head having a heater and mounted on a carriage which moves over a recording medium in a scanning manner; and an ink container for containing solid-phase ink, the solid-phase ink in the ink container being supplied near to the nozzles of the ink jet head, liquefied by heating, and jetted through the nozzles. In the device and method, the ink is molten in the vicinity of the ink jetting section in the ink jet head, and therefore, the quantity of ink in the head is small. Accordingly, the head may be small in size and in thermal capacity, and the carriage may be small in weight, and in addition, the heating time short. Furthermore, the liquefied ink in the head is consumed quickly.

Still further, the foregoing object of the invention has been achieved by the provision of an ink jet head provided in an ink jet apparatus, which comprises: a nozzle board having a plurality of nozzle orifices; and a plurality of pressure generating members arranged to confront with the nozzle orifices, respectively, upon application of voltage the pressure generating member being displaced in the ink in an ink chamber to jet ink droplets, in which at least one of walls forming the ink chamber and an ink supplying path communicating with the ink chamber is made of a heat generating member. In the ink jet head thus organized, the one wall made of the heat generating member in the ink chamber is in direct contact with the ink, and upon application of voltage thereto, it generates heat immediately, so that the solid ink is molten by thermal conduction, thus being held at high temperature.

Still further, the foregoing object of the invention has been achieved by the provision of an ink jet head in an ink jet type recording apparatus, comprising: a housing made of a material high in heat conduction, the housing having at least one heat source, and arranged to confront with a recording medium; ink holding means arranged inside the housing, the ink holding means transmitting heat generated by the heat source thereby to melt the ink and holding the ink thus molten by capillary action; a nozzle-formed member being part of the ink holding member, and having at least one nozzle orifice arranged confronted with the recording medium; and pressure generating member arranged inside the ink holding means, for generating a pressure which causes the ink near the nozzle orifice to jet in the form of ink drops. In the ink jet head, the ink holding means may comprise a plurality of plate-shaped members stacked with gaps therebetween.

Still further, the specific feature of an ink jet type recording method according to the invention resides in that ink in solid phase is supplied in such a manner that the ink is brought into direct contact with the ink holding means; the ink thus supplying is molten by the heat of the ink holding means, the ink thus molten is sucked into the ink holding means by capillary action, and the molten ink in the ink holding means is jetted in the form of ink droplets by the pressure generating by the pressure generating means. According to the invention, the gap forming members good in heat conduction are provided in the ink jet head, so that the molten ink is held in the gap by surface tension. Therefore, even when the posture of the ink jet head is changed—for instance when the ink jet head falls down accidentally—the liquefied ink in the head will not leak out. And when the power switch is turned on, the solid-phase ink is liquefied quickly.

Other object, features, and characteristics of the present invention, as well as the methods of operation and functions of related elements of the structure, will become apparent upon consideration of the following description and appended claims with reference to the accompanying drawings, all of which form a part of this specification, wherein like reference numerals designate corresponding parts in the various figures.

DETAILED DESCRIPTION OF THE PREFERRED EMBODIMENTS

Figure 1A:
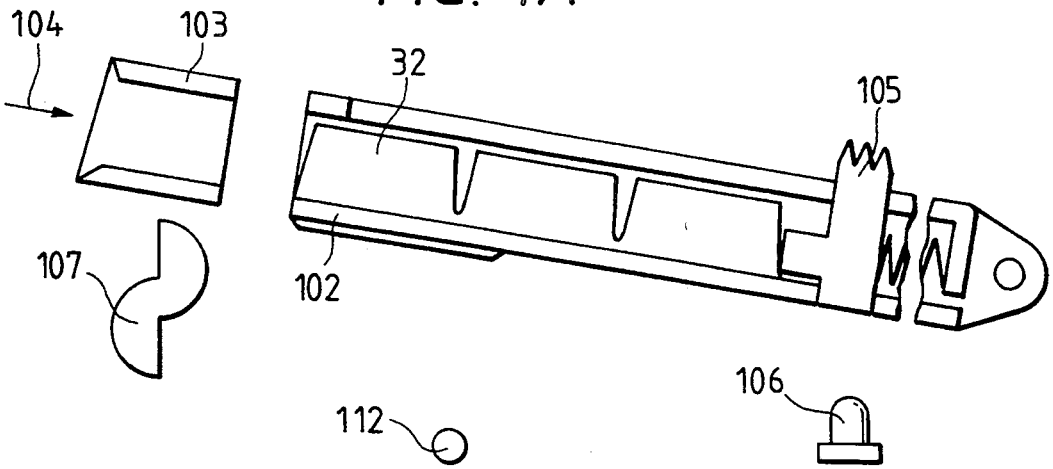
FIGS. 1A, 1B and 1C are explanatory diagrams for a description of a solid-phase ink supplying method provided in an ink supplying device according to this invention.
Figure 1B:
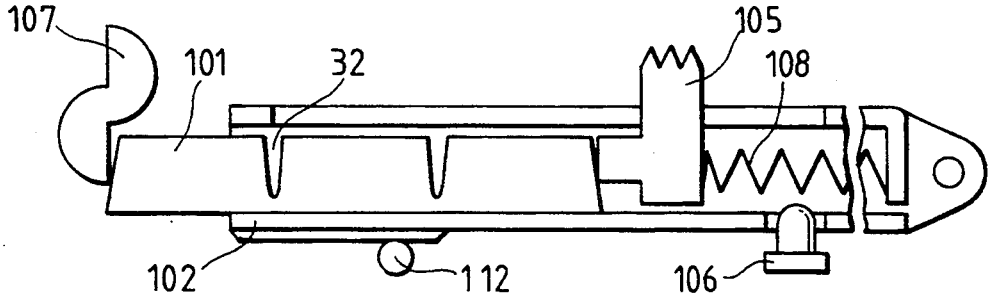
Figure 1C:
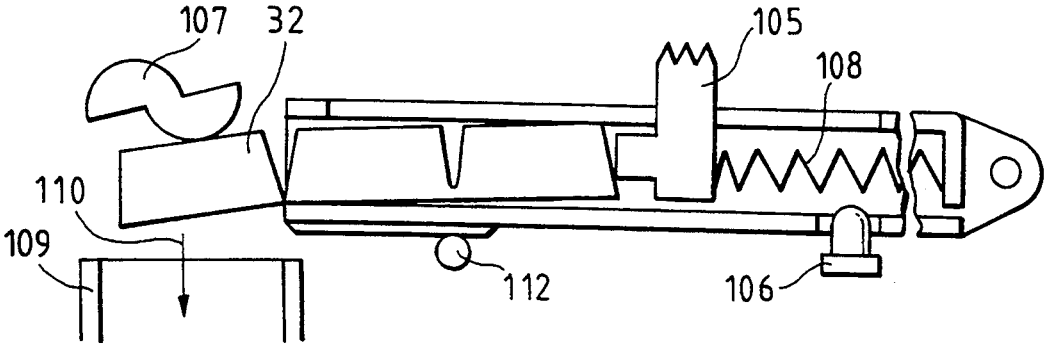

FIGS. 1A through 1C illustrate a solid-phase ink supplying apparatus and method according to one-embodiment of the present invention. Referring to FIG. 1A, a plurality of solid-phase ink blocks 32 molded in the form of a bar are loaded into an ink container 102 through an ink loading inlet 103 as indicated by the arrow 104.

A slider 105 is manually moved to a lock position through the solid-phase ink blocks 32, and it is locked being engaged with a hole formed in the ink container by a leaf spring (not shown). The slider 105 serves also as an indicator showing the remaining quantity of ink. Thereafter, the ink container 102 is automatically moved to the position as shown in FIG. 1B, and the slider 105 is released by a releasing pin 106 so that the solid-phase ink blocks 32 are pushed against a breaking cam 107 by the elastic force of a spring 108. Under this condition, as shown in FIG. 1C, the breaking cam 107 is rotated to break the solid-phase ink blocks 32 to cut out a solid-phase ink block 32. The solid-phase ink block 32 thus cut out is allowed to drop into an ink pooling chamber 109 as indicated by the arrow 110. The solid-phase ink blocks 32 in the form of a bar are bordered by grooves 111 formed therebetween, for the purposes of stabilizing the quantity of ink to be supplied and decreasing the torque applied to the breaking cam 107.

The solid-phase ink block thus dropped in the ink pooling chamber is heated by a heater (not shown) and supplied into an printing head (not shown) to perform a printing operation.

Figure 2:
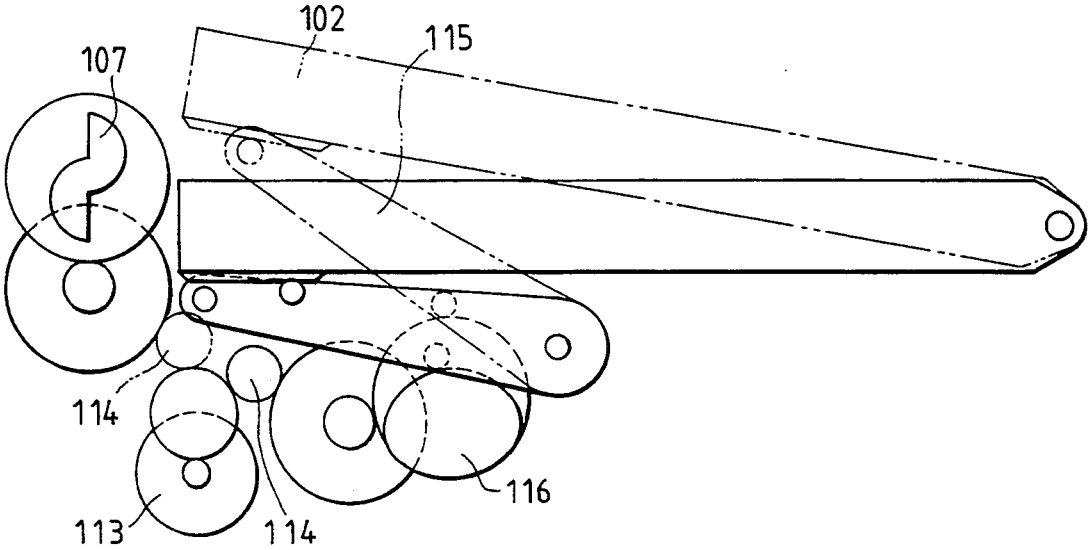
FIG. 2 is an explanatory diagram showing the operation of an ink supplying device shown in FIGS. 1A through 1C.

FIG. 2 illustrates a drive system for rotating the breaking cam 107 and vertically swinging the ink container 102 shown in FIGS. 1A to 1C. That is, the drive force of an electric motor 113 is utilized through a planet gear 114, depending on the direction of rotation, selectively to rotate the breaking cam 107 or to swing the ink container 102 with the aid of lever cam 126 and a lever 115.

In the embodiment, where the motor 113 rotates counterclockwise, the drive force is transmitted through the planet gear 114 (indicated by the solid liner) and a reduction gear to the lever cam 116, so that every 180° rotation of the latter 116 the ink container 102 is swung vertically through the lever 115. In this operation, the on-off control of the drive force of the motor is carried out by means of a detector comprising, for instance, a micro-switch and a cam which is so designed as to detect the 180° rotation of the lever cam 116.

When the ink container is lifted as indicated by the one-dot chain line, the solid-phase ink blocks in the form of a bar are loaded into the ink container 102. When the ink container is lowered as indicated by the solid line, the solid-phase ink blocks are broken to cut out one solid-phase ink block, which is allowed to drop into the ink pooling chamber 109. When the ink container is lowered, a stopper 112 is utilized as shown in FIGS. 1A through 1C; that is, the ink container is lowered until it strikes against the stopper 112.

In the case when the motor 113 is rotated clockwise, the drive force is transmitted through the planet gear 114 (indicated by the two-dot chain line) and a reduction gear to the breaking cam 107, to break the solid-phase ink blocks in the form of a bar as was described above. In this operation, the on-off control of the drive force of the motor is achieved by detection of the 180° rotation of the breaking cam 107.

Figure 3:
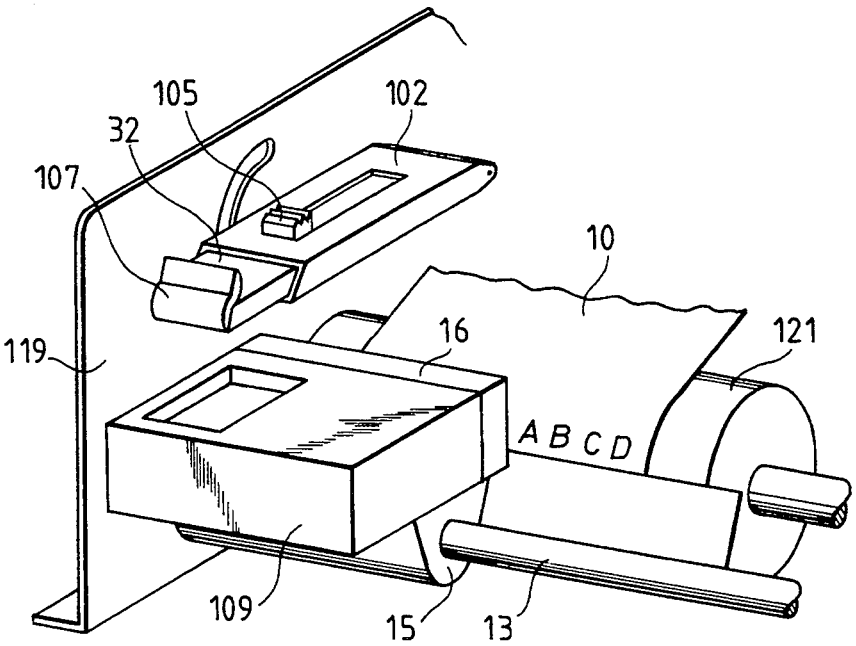
FIG. 3 is a perspective view showing a part of a printer to which the ink supplying device shown in FIGS. 1A through 1C is applied.

FIG. 3 illustrates a printer to which the solid-phase ink supplying system described in FIGS. 1A through 1C is applied. The drive system including the ink container 102 and the breaking cam 107 is arranged on a side frame 119 which is substantially perpendicular to a guide shaft 13 which is used for the main scanning operation of the printing head 16; that is, it is unnecessary to arrange the drive system on the carriage 15. Therefore, the weight of the carriage is maintained unchanged. In FIG. 3, reference numerals 21 and 22 designate a platen and a printing sheet, respectively.

Figure 4:
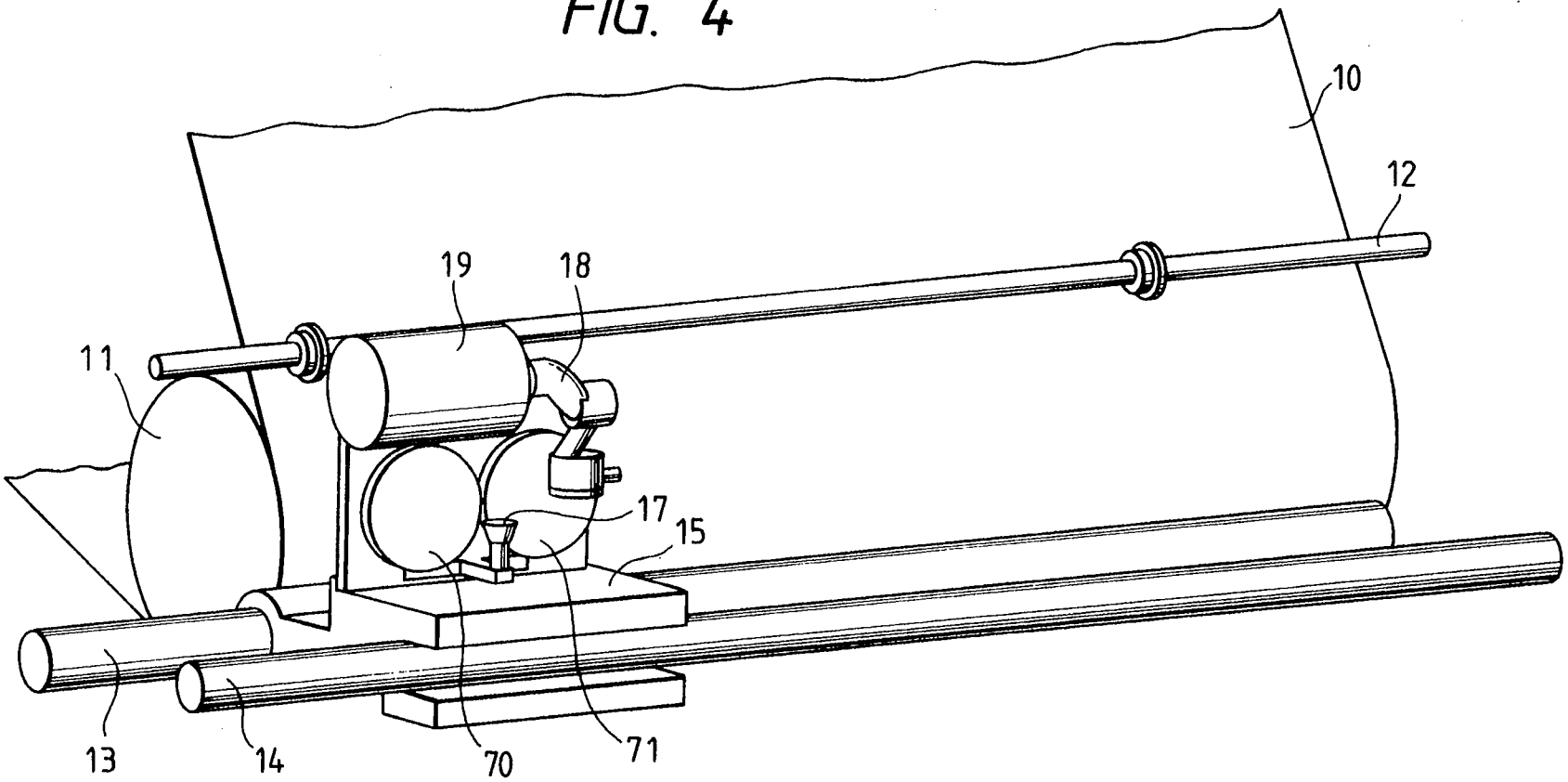
FIG. 4 is a perspective view of an ink jet type printer according to this invention.

FIG. 4 illustrates a printer according to another embodiment of the present invention. As shown in FIG. 4, a recording sheet 10 is wound on a platen 11, and driven while being pushed by a feed roller shaft 12. An ink jet head 16 (herein after referred to merely as "a head 16", when applicable) is mounted on a carriage 15 which is movable in parallel with the axis of the platen being guided by guide shafts 13 and 14. The head is held at high temperature by head heaters 70 and 71 so that the ink therein is kept in liquid state. The head 16 has a plurality of nozzles the ink jetting operations of which can be controlled separately form one another, and it is moved along the platen axis, in a main scanning direction, which selectively causing the nozzles to jet ink, thus forming an image on the recording sheet 10. In this operation, as the platen 11 is rotated, the recording sheet 10 is moved in an auxiliary scanning direction perpendicular to the main scanning direction, so that for instance characters are printed on it. In the printer, an ink supplying device 18 is provided on the side of the head movement starting position, and it is coupled to an ink container 19 which contains solid-phase ink. The ink supplying device 18 is swingable supported.

The head 16 includes a frame made of heat conducting material; and vibrators and a nozzle board mounted on the frame. The vibrators are made up of piezoelectric elements, and the nozzle board has nozzle orifices confronting the vibrators. The structure of the head has been described, for instance, in the specification of Japanese Patent Application Publication No. Sho 60-8953 in detail. The head includes a heater 70 plus the heater 71, and an ink quantity detecting sensor (not shown) for detecting an ink level thereby to detect whether or not the quantity of ink in the head is a predetermined value, and has an ink supplying inlet 17.

The operation of the printer thus constructed will be described. At the start of the operation, the head heaters 70 and 71 are driven to heat the head. The head being heated in this manner, the ink closer to the head heaters begins to melt. In a predetermined period of time, that is, when the ink has been molten as much as necessary for starting a printing operation, the head starts the printing operation. In the printing operation, an ink jetting operation is carried out; that is, the ends of the vibrators are selectively displaced towards the nozzle board to jet the ink through the respective nozzle orifice. When the ink quantity detecting sensor in the head detects when the quantity of ink in the head is smaller than the predetermined value, an ink supply command signal is outputted.

Figure 5A:
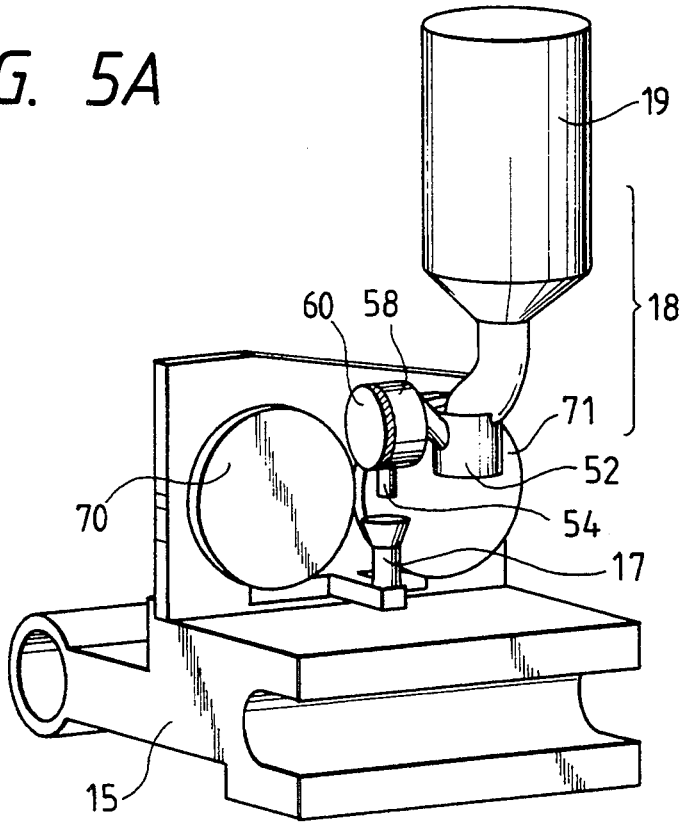
FIG. 5A and 5B are perspective view of or a description of the operation of an ink supplying device used in the printer of FIG. 4.
Figure 5B:
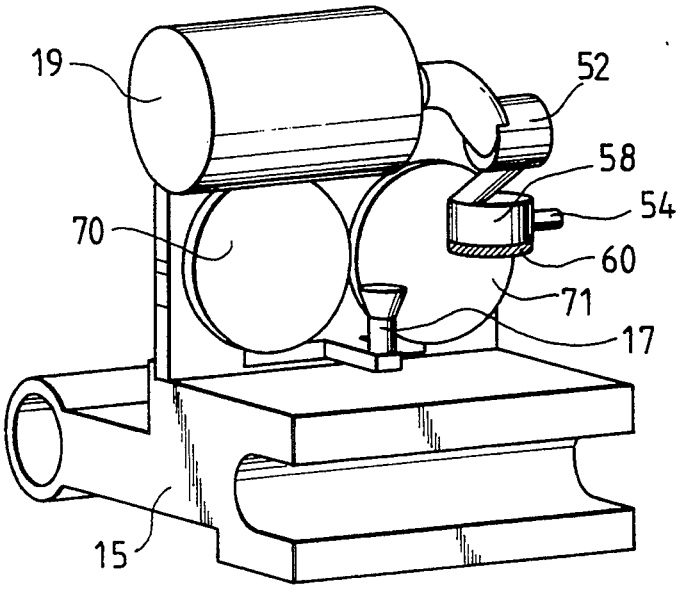

Referring to FIGS. 5A and 5B, an ink supplying operation will be described hereafter.

An ink container 19, in which ink grains (not shown) are put, is coupled to the ink supplying device 18, and is held as shown in FIG. 5B. The ink supplying device 18 is turned so that it is held as shown in FIG. 5A, as a result of which a certain quantity of ink grains, which is determined according to the volume of a measuring section 52, are transferred from the ink container into the measuring section 52 by their own weight. Under this condition, the ink supplying device 18 is turned again so that it is held as shown in FIG. 5B. As a result, the ink grains are moved from the measuring section 52 over to a heater section 58, where they are liquefied by an ink container heater 60 provided at the heater section 58. In response to the ink supply request signal from the head, the latter is moved to the ink supplying position. Thereafter, the ink supplying device is turned again so that it is held as shown in FIG. 5A. As a result, the liquefied ink is run through an ink supplying pipe 54 by its own weight, thus dripping into the ink supplying inlet 17. At the same time, the predetermined quantity of ink grains are supplied from the ink container to the measuring section 52. The ink supplying device 18 is positioned again as shown in FIG. 5B, so that the ink grains are transferred from the measuring section into the heater section, where they are liquefied by heating. In response to the ink supply command signal, the liquefied ink is supplied to the head. Thus, the printing operation is continued while the ink is being suitably supplied with its consumption.

The ink container is made up of a material poor in thermal conduction, so that only the ink in the heater section is heated, and the ink remaining in the ink container is not heated, with the result that the amount of heat required for melting the ink grains is minimized.

Supplement of the ink can be achieved merely by coupling the ink container to the ink supplying device. Since the ink supplying device is provided on the printer body, the ink container can be readily connected to or disconnected from it. In this case, unlike the case where the ink container is mounted on the carriage, there is no limitation in size or in weight, and a sufficient quantity of ink can be held.

Furthermore, in the invention, the quantity of ink in the head is small, and accordingly the head and the carriage can be miniaturized. Therefore, the period of time required for heating the ink before a printing operation can be reduced, and the amount of heat for keeping the molten ink at high temperature can be also reduced.

Figure 6:
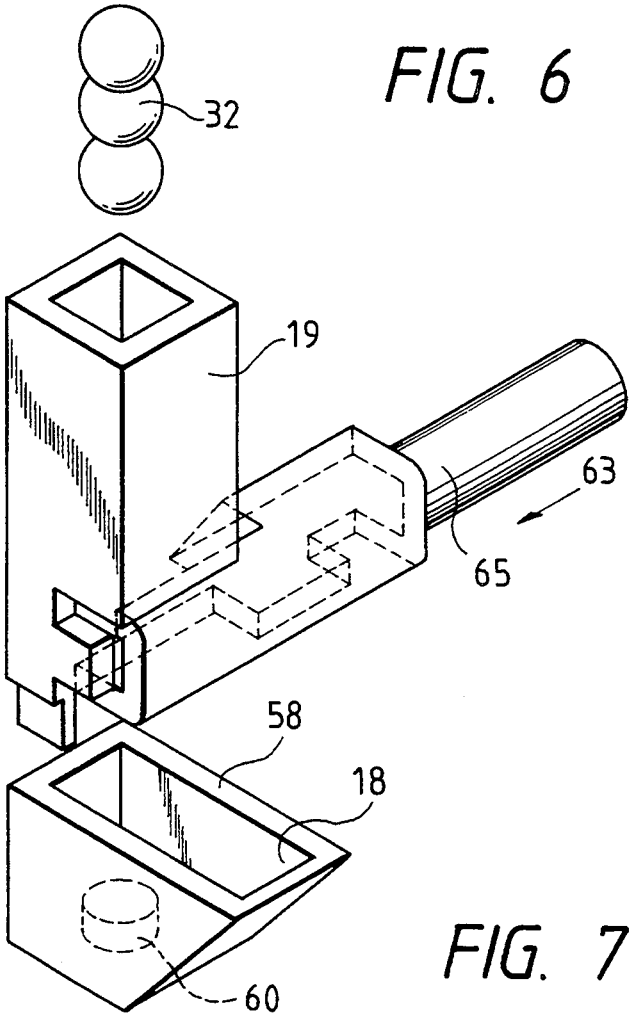
FIG. 6 is a perspective view showing an ink supplying device in another embodiment of the invention.

FIG. 6 illustrates an ink supplying device according to a further embodiment of the invention. As shown in FIG. 6, an ink container 19 (shown with parts cut away), in which ink balls 32 are put, have a lever 65 for dropping the ink balls one after another. The ink balls, being moved by their own weight downwardly in the ink container 19, are held stacked on the lever 65. When the lever 65 is moved a predetermined distance in the direction of the arrow 63, only the lowermost ink ball is dropped off the ink container by the cut formed in the lever, while the remaining ink balls are dropped by their own weight, and held stacked on the lever 65. When the lever 65 is returned to the original position as shown in FIG. 6, the ink balls are moved to the bottom of the ink container. On the other hand, the ink ball dropped off the ink container enters a heater section 35 having an ink container heater 60, so that it is molten in its entirety. Similarly as in the above-described first embodiment of the invention, in response to the ink supply request signal from the head, the latter is moved to just below the ink supplying device. Under this condition, the heater section is turned with its ink supplying section held underneath, to supply the ink into the head. The above-described operation is repeatedly carried out so that the ink can be continuously supplied with the consumption of ink of the head.

In the above-described embodiment, the ink melting heater may be a heat generating resistance element (trade name "posister") having an automatic temperature control function that resistance is increased at high temperature. In this case, immediately after the supply of solid-phase ink into the ink supplying device, electric power is greatly consumed because it is at room temperature, but after the ink has been molten, the heater is at high temperature, and therefore electric power is used only for complementing the dissipation of heat through radiation. Therefore, electric power is economically used, and it is unnecessary to provide a temperature control circuit.

Furthermore, in the above-described embodiments, immediately after the liquefied ink has been supplied to the head, the solid-phase ink is led into the ink container heater section; however, for the purpose of economically using electric power, the timing of operation may be so designed that the solid phase ink is transferred into the ink container heater section immediately before the supplying of the liquefied ink to the head.

In the above-described embodiments, the quantity of ink in the head is detected by means of the ink quantity detecting sensor. However, they may be modified as follows: A window for visually detecting the quantity of ink remaining in the head is provided (preferably near the nozzle board). With the modification, the operator monitors the quantity of ink remaining in the head, and operates a key, when necessary, to start the above-described ink supplying operation.

In the above-described embodiments, the ink is in the form of a grain or ball; however, it should be noted that the invention is not limited thereto or thereby. That is, the configuration and weight of the solid-phase ink should be so designed that the ink is excellent in fluidity, and its volume is smaller than the measuring unit.

In supplying ink to the head, the rocking of the ink container or the operating of the lever may be achieved by using a drive source such as an electric motor or plunger provided at the movable section, or by utilizing an external movement such as the carriage movement.

Figure 7:
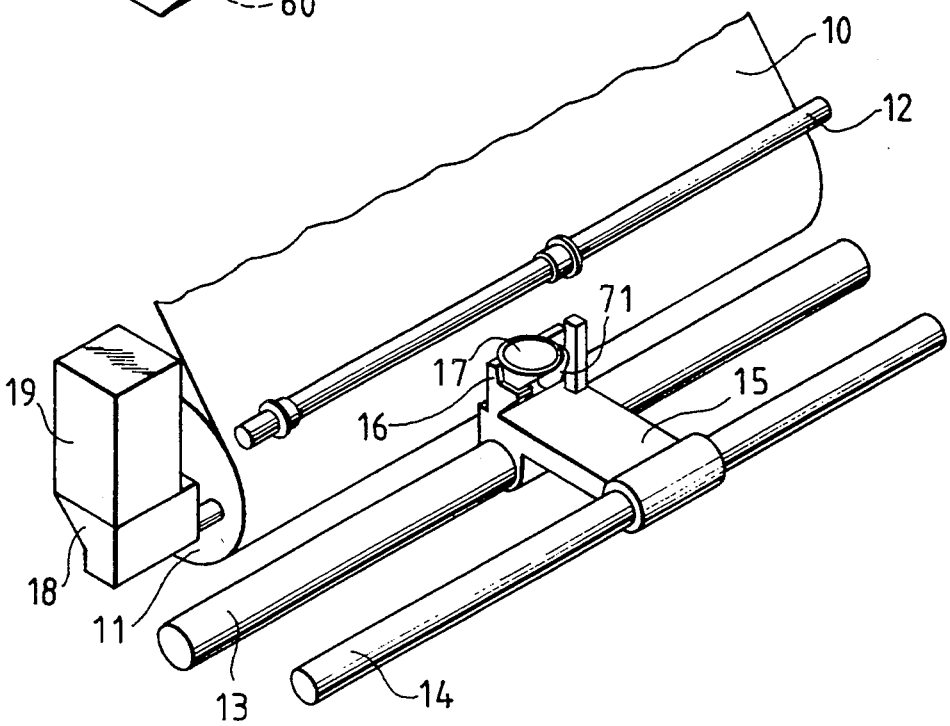
FIG. 7 is a perspective view of an ink jet type printer in another embodiment of this invention.

FIG. 7 illustrates a printer which is provided with a head shown in FIG. 8A according to a still further embodiment of the present invention. Like reference numerals shown in FIG. 7 designate corresponding parts in FIG. 4. In the printer shown in FIG. 7, the ink supplying device 18 may not be swingable.

Figure 8:
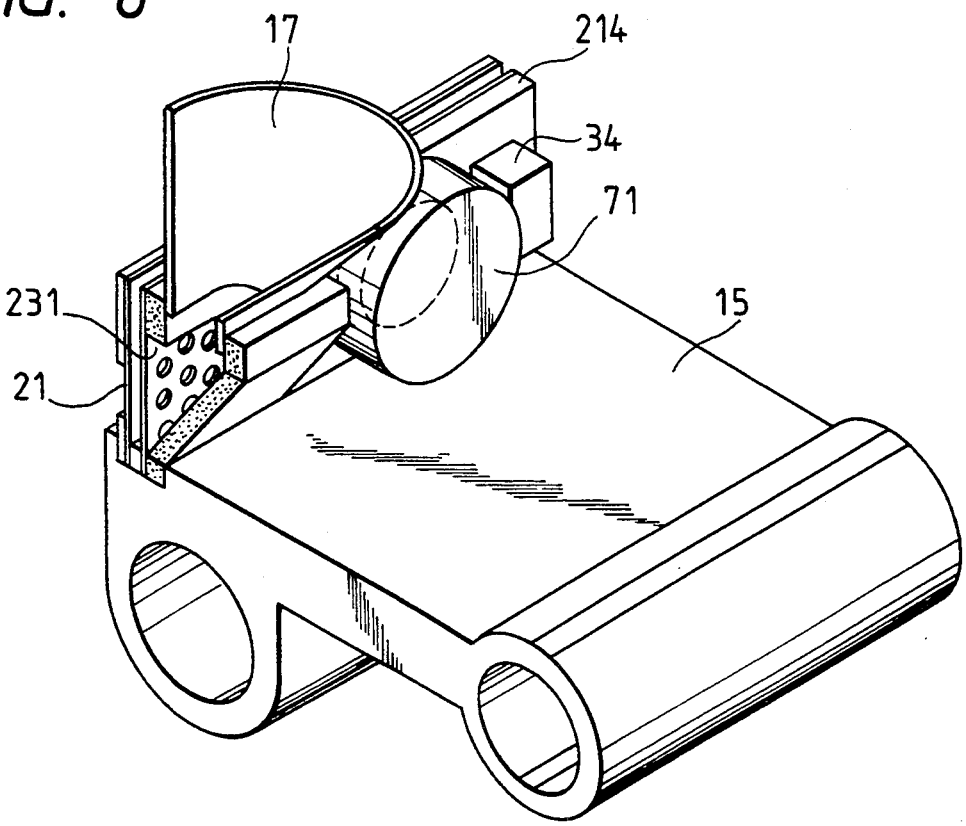
FIG. 8 shows a perspective view showing an ink jet head of this invention.

The head shown in FIG. 8 includes a frame 214 made of heat conducting material; and vibrators (not shown) and a nozzle board 21 mounted on the frame. The vibrators are made up of piezo-electric elements; and the nozzle board 26 has nozzle orifices confronting the vibrators. The head includes a heater 71, an ink quantity detecting sensor 34 for detecting an ink level thereby to detect whether or not the quantity of ink in the head is a predetermined value, and an ink supplying inlet 17. Components for guiding the solid-phase ink and those provided outside the heater are made of material poor in heat conduction.

The operation of the printer thus constructed will be described. At the start of the operation, the heater 71 is driven to heat the head. As a result, the ink is molten beginning with its portion closer to the heater. In a predetermined period of time; i.e., when the ink has been molten as much as necessary for starting a printing operation, the head starts the printing operation. In the printing operation, an ink jetting operation is carried out; that is, the ends of the vibrators are selectively displaced towards the nozzle board to jet the ink through the respective nozzle orifices. Since the invention relates to the operation of supplying ink to the head, the detailed description of the operation of the head will not be made here. When the ink quantity detecting sensor 24 detects the quantity of ink in the head smaller than the predetermined value, an ink supply request signal is outputted.

Returning to FIG. 6, an ink supplying operation for the head thus constructed will be described.

As shown in FIG. 6, ink balls 32 are put in an ink container coupled to an ink supplying device. In response to the ink supply request signal from the head, the latter is moved to the ink supply position so that the ink supplying outlet of the ink supplying device aligns with the ink supplying inlet 17. Under this condition, the ink supplying lever 65 of the ink supplying device is operated to drop the ink balls into the head. The ink container (with parts cut away to show an ink supplying mechanism only) in which the ink balls 32 is put has the ink supplying lever 65 at the bottom which is used to drop the ink balls one by one. The ink balls, being moved by their own weight downwardly in the ink supplying device, are held stacked on the ink supplying lever 65. When the ink supplying lever 65 is moved a predetermined distance in the direction of the arrow 63, only the lowermost is dropped off the ink supplying device through the cut formed in the lever, thus being supplied into the head. At the same time, the remaining ink balls are dropped by their own weight, and held stacked on the lever 65. When the lever is returned to the original position as shown in FIG. 6, the ink balls are moved to the bottom of the ink supplying device. The ink ball in the head is molten by the heater. That is, the ink ball dropped into the ink supplying inlet 17 is led into the head by its own weight because it is shaped small in rolling resistance, and in the head, it is detained by an isolating board 231. The components around the ink ball are of material poor in heat conduction, and the isolating board 231 is a metal plate having 300-mesh small holes and is held at high temperature by the heater. Therefore, the ink ball is molten beginning with its portion which is in contact with the isolating board 231, and the molten ink is allowed to flow through the small holes into the nozzle section.

Figure 9:
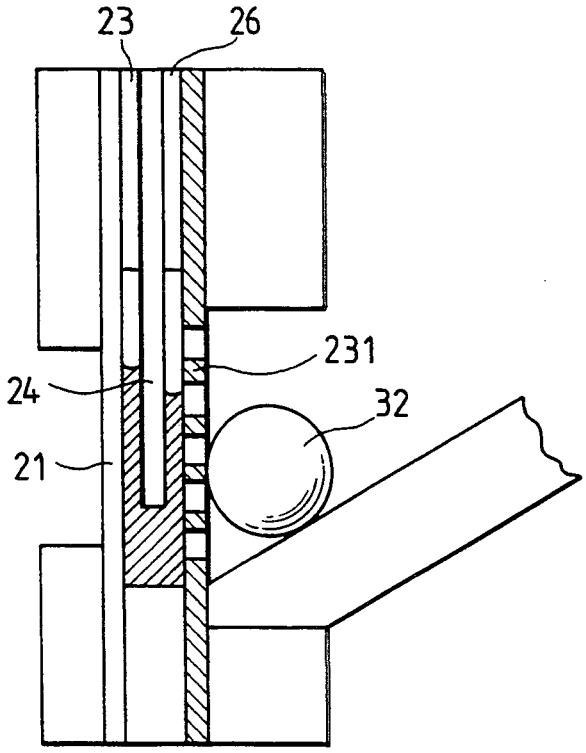
FIG. 9 is a sectional view of the ink jet head shown in FIG. 8.

This operation will be described with reference to FIG. 9 in more detail. The ink ball in contact with the isolating board 231 is molten as described above. The head has a nozzle board 21, and a vibrator board 24 with cantilevered vibrator elements which is laid over the nozzle board 21. In the head thus constructed, the gap between the nozzle board and the vibrator board is about ten (10) microns, and the gap between the nozzle board and the isolating board is 0.8 mm. The liquefied ink goes into those gaps by capillary force. In this connection, the inventors have found it through experiments that, in order to prevent the liquefied ink from being affected by the acceleration applied to the head or the change in posture of the head, the gap should be 2 mm or less, preferably 0.8 mm or less. In the head, the level of the liquefied ink in the gap being high, the liquefied ink will flow to the nozzles quickly. Accordingly, all the liquefied ink is held in the gap, thus being free from the above-described disturbance. This will ensure the stable operation of the head. In the head thus designed, the quantity of ink in the head may be small, and therefore, the head and the carriage can be miniaturized as much. Accordingly, the heating time prior to the printing operation can be reduced, and the amount of heat required for maintaining the liquefied in at high temperature can be decreased. Furthermore, since the ink ball is molten beginning with its portion in contact with the isolating board wich is held at high temperature and has the small holes, it will molten quickly. The small holes of the isolating board serve as a filter for preventing the entrance of foreign matters.

Figure 10:
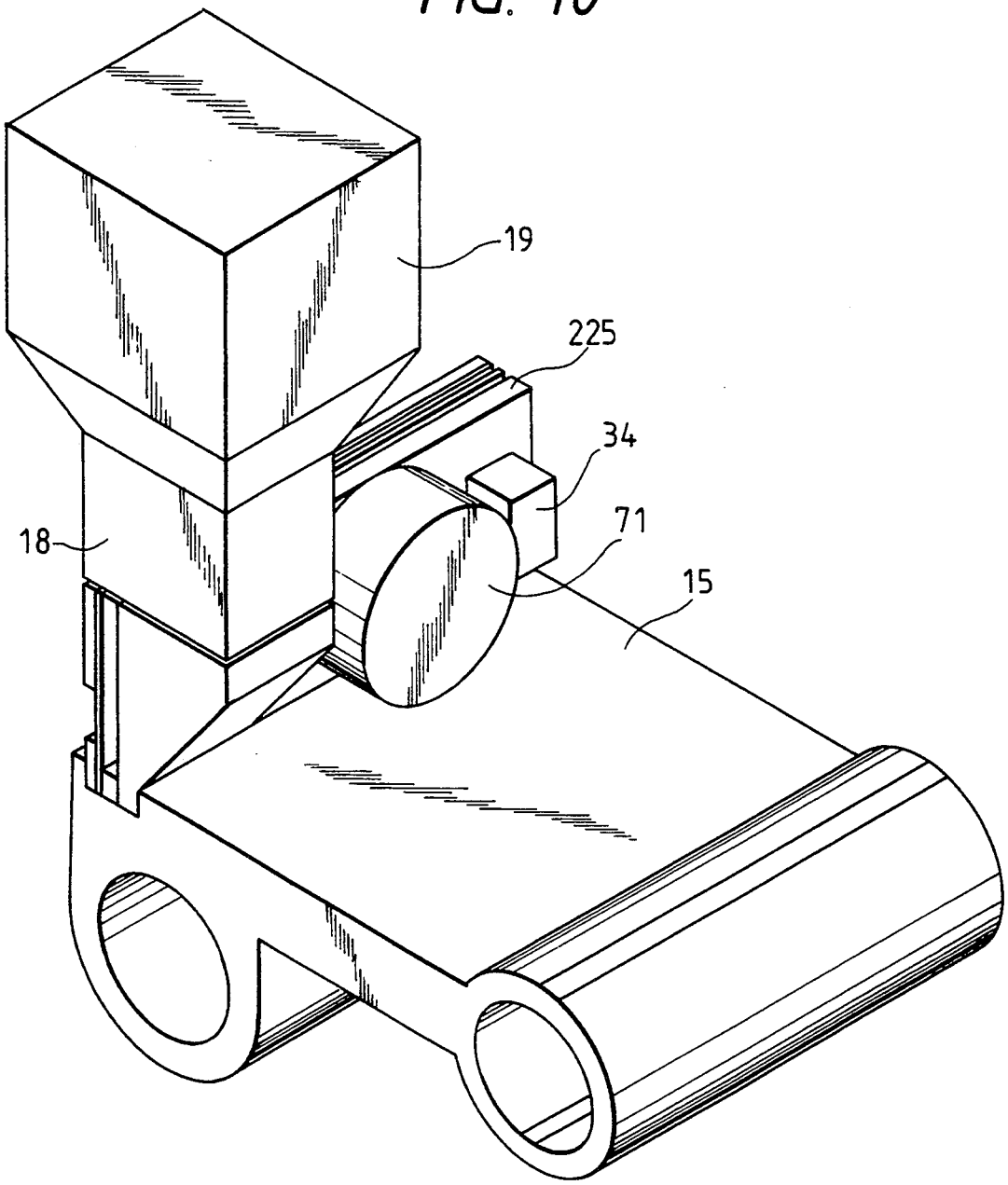
FIG. 10 is a perspective view of an ink jet head in a modified embodiment of FIG. 8.

FIG. 10 illustrates a head which is different from that shown in FIGS. 7 and 8 in that an ink supplying device is fixedly mounted on the head. In this case, it is unnecessary to move the head to the ink supplying position prior to the ink supplying operation; that is, the ink supplying operation can be started quickly when the ink supply request signal is issued.

In the above-described embodiments, the ink melting heater may be a heat generating resistance element (called "posister (trademark)"). In this case, it is unnecessary to provide a temperature control circuit.

Furthermore, in the above-described embodiments, the quantity of ink in the head is detected by means of the ink qunatity detecting sensor. However, they may be modified in such a manner that a window for visually detecting the quantity of ink remaining in the head is provided (preferably near the nozzle board) so that the operator monitors the quantity of ink in the head, and when necessary operates a key to start the above-described ink supplying operation.

In the above-described embodiments, the ink is in the form of a ball; however, it should be noted that the invention is not limited thereto or thereby; that is, the ink may be in the form of a grain, ball or cylinder if the configuration and size thereof meet the conditions that the ink is excellent in fluidity, thus flowing by its own weight, and is smaller in volume than the predetermined value.

In supplying ink to the head, the lever may be operated by means of a drive source such as an electric motor or plunger provided at the movable section, or by utilizing an external movement such as the carriage movement.

Figure 11:
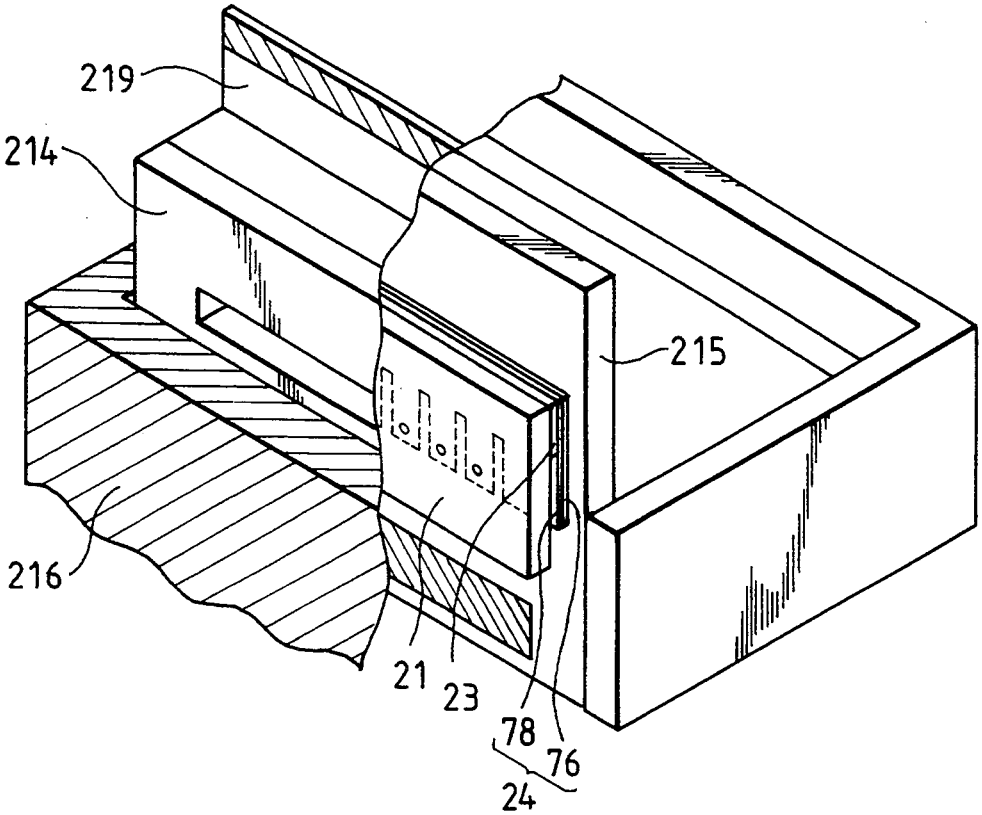
FIG. 11 is a sectional view of an ink jet head in another embodiment of the invention.

FIG. 11 is a perspective view showing a part of an ink jet head according to a still further embodiment of the invention. The ink jet head is constituted by a piezo-electric vibrator 24 serving as a pressure generator, the piezo vibrator 24 formed by joining a piezo-electric element 76 and a metal plate 78; a nozzle plate 21 having a number of nozzle orifices; a spacer 23 interposed between the nozzle plate and the piezo vibrator to provide a predetermined gap therebetween; a main frame 214 made up of a heat generating member, the main frame fixing the nozzle plate and forming an ink supplying path; and an auxiliary frame 215 made of the same material as the main frame 214. The frames 214 and 215 are covered with a heat insulating material 216 in order to prevent the radiation of heat through them.

The piezo-electric vibrator 24 is made up of a plurality of cantilevered vibrator elements each being supported at one end and hanging free at the other end. That is, the supporting ends of the cantilevered vibrator elements are coupled together to form the piezo-electric vibrator 24. Each of the vibrator elements had on one side a segment electrode layer, or an Au (gold) layer, formed on the piezo-electric element 76, and on the other side a common electrode layer, or the above-described metal plate. The segment electrode layers of the vibrator elements are connected to an FPC (flexible printed circuit board) 219 so that they are electrically connected to external equipment.

Figure 12:
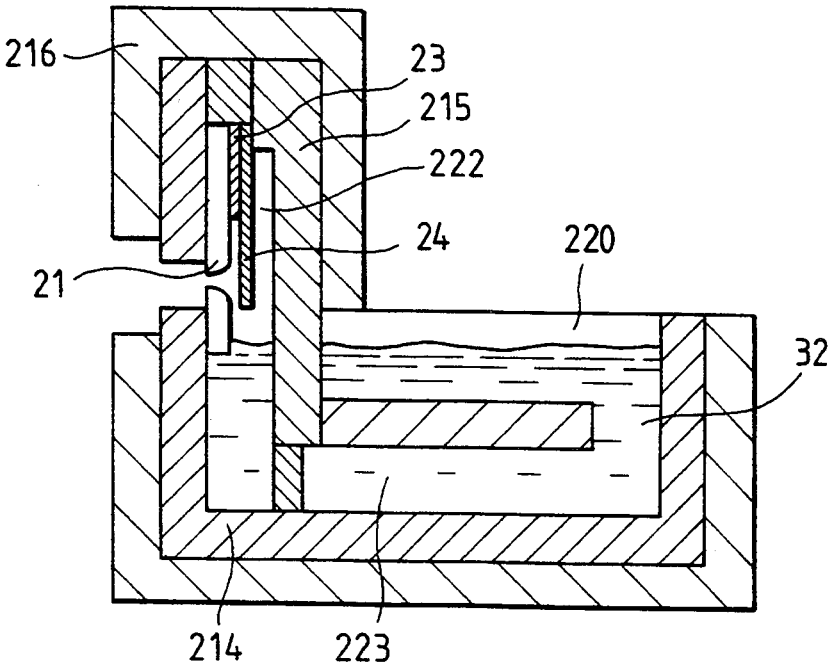
FIG. 12 is a sectional view of the ink jet head of FIG. 11.

FIG. 12 illustrates a sectional view of the ink jet head described in FIG. 10. Ink 32 supplied from an ink tank 220 is in solid phase at room temperature. In the embodiment, the frames 214 and 215 being made up of the "posister (trade name)" (manufactured by Murata Seisakusho Co., Ltd.), upon application of a voltage thereto the walls of an ink chamber 222 and an ink supplying path 223 generate heat immediately, so that the temperature of the ink is increased according to the thermal characteristic of the "posister". As a result, the solid ink is molten at the melting point, thus being supplied into the ink chamber. Thus, the ink jet head has become ready for a printing operation.

Because of the characteristic of the "posister", the smaller the resistance at room temperature, the larger the rush current and the quicker the temperature rise. Therefore, in order to reduce the time of preheating the ink jet head, it is essential to use the "posister" smallest in resistance at room temperature. The "posister" has an automatic temperature control function, and therefore the ink is maintained unchanged in temperature independently of the change in temperature of the outside; that is, the ink jet head is stable in ink jet characteristic.

Figure 13:
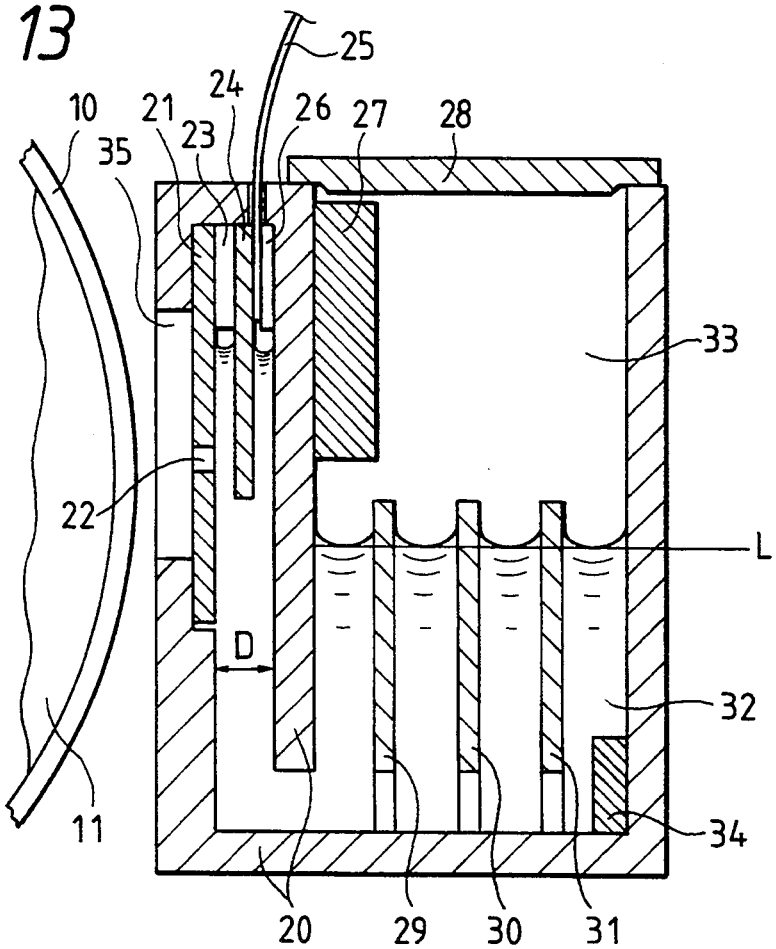
FIG. 13 is a sectional view of an ink jet head according to a further embodiment of this invention.

FIG. 13 illustrates a sectional view of an ink jet head according to a still further embodiment of the invention. As shown in FIG. 13, a container-like housing 20 made of material high in thermal conduction is so positioned that an opening 35 formed in its one side is confronted with the recording sheet 10 wound on the platen 11. Held behind the opening 35 in the housing 20 are a nozzle forming member, namely, a nozzle plate 21 having a plurality of nozzle orifices 22 arranged along the platen axis, a spacer 23, pressure generating members, namely, vibrators 24, electrical conductors 25, and an elastic member 26. Each of the vibrators 24 is a laminate of a piezo-electric element and a metal foil of Ni or SUS which is flexible like a bimetal plate, and it is cantilevered; more specifically, its one end together with the nozzle plate 21 and the spacer 23 is fixedly held under a predetermined pressure by the rigidity of the housing 20 and the elasticity of the elastic member 26, whereas the other end is hung free. The vibrators 24 are so positioned that the free ends thereof confront with the nozzle orifices 22 formed in the nozzle plate 21, respectively. A small gap is held between the nozzle plate 22 and the vibrators 24 by the spacer 23 with high accuracy.

In the head, ink holding means is formed by walls of the housing 20, the nozzle plate 21, and plate-shaped members 29, 30 and 31 which are arranged with gaps D of 2 mm or less therebetween, as shown in FIG. 13. In one of the gaps D, the pressure generating members, namely, the vibrators 24 are provided. The gaps D formed by the plate-shaped members 29, 30 and 31 are made in parallel with one another by gap regulating means (not shown). The lower end portions of the plates-shaped members 29, 30 and 31, which are in contact with the bottom of the housing 20, have holes through which ink 32 flows into the adjacent gaps. In the head in which the level L of the ink 32 is held below the axes of the nozzle orifices 22 at all times as described later, the gaps D must be a certain value or less which is determined from head configuration, and ink physical properties and surface tension so that the leakage of the liquefied ink 32 is prevented irrespective of the postures of the head at all times. When two plates are held in the air in such a manner that they are in parallel with each other with a certain gap therebetween, and are extended in the direction of gravity, a liquid can be held stable between the two plates in a certain range of the direction of gravity, because the weight of the liquid balances with the surface tension thereof which occurs between the liquid and the surfaces of the plates which are in contact with it. Application of this principle to a ink jet head has result in the present invention. In order that the above-described principle may be applied no matter what posture the head assumes, the gap D should be set to a value or less which may be acceptable with the head configuration, i.e., available in the ink holding means, and with which the weight of the ink 32 balances with the surface tension thereof which occurs between the ink and a part which is in contact with the ink. In addition, the gap D should be small enough to the extent that the ink in the ink holding means is raised to the nozzle orifices 22, and the variation of the ink level is suppressed during movement of the carriage 15. Fruthermore, the gap should be such that, whenever bubbles are formed in the ink during liquefaction, it can be let them go, and it allows the continuous supply of ink in the ink jetting operation; that is, it permits the ink to be sufficiently supplied to the nozzles while it is being jetted at high frequency.

As shown in FIG. 13, an ink level detecting device 34 is provided in the ink holding means. The device 34 operates to detect when the level L reaches a predetermined value or lower. When it is detected by the device 34 that the level L has reached the predetermined value or less, the cover 28 of the housing 20 is opened, so that an ink block is supplied into a solid-phase ink receiving chamber 33 from a solid-phase ink container (not shown). The volume of the ink block supplied into the solid-phase ink receiving chamber 33 is such that, when it is completely molten, the level L will not go above the axes of the nozzle orifices 22, and when it is supplied into the solid-phase ink receiving chamber, it will be brought into direct contact with the upper ends of the plate-shaped members 29, 30 and 31.

A heat source, namely, a heater 27 is provided on one wall of the housing 20 behind the pressure generating means. FIG. 13 shows only one heater 27; however, it should be noted that the invention is not limited thereto or thereby. That is, a plurality of heaters may be arranged at a plurality of positions, with the thermal efficiency taken into consideration. The plate-shaped members 29, 30 and 31 and the gap regulating member (not shown) are thermally coupled to the housing 20, so that heat generated by the heater 27 is transmitted quickly to the ink 32 to heat it and maintain it at high temperature.

The operation of the ink jet head thus constructed will be described.

The head being heated beginning with its portion closer to the heater, the ink block 32 is liquefied beginning with its portion closer to the pressure generating section. In a predetermined period of time; that is, when a predetermined quantity of molten ink necessary for starting a printing operation is obtained, the head starts the printing operation. With the head of the invention, the contact areas of the plate-shaped members 29, 30 and 31 and the housing 20 with the ink block 32 are large, and therefore the aforementioned predetermined period of time is short; that is, the printing operation can be started quickly.

Now, the ink jetting operation of the head will be described. When electrical signals are applied selectively to the vibrators 24, the piezo-electric elements contract by piezo-electric effect, while the metal foils, being high in rigidity, are suppressed in dimensional change. As a result, each of the vibrators 24 is curved towards the nozzle plate 21 so that pressure is generated in the small gap between the nozzle plate 21 and the vibrator 24, thus jetting ink droplets.

When, thereafter, it is detected by the ink level detecting device 34 that the level of the ink in the head is the predetermined value or lower, an ink supply request signal is outputted.

The ink supplying operation will be described. The ink pellet 39 supplied into the solid-phase ink receiving chamber 33 from the ink supplying device as shown in FIG. 6 is brought into direct contact with the plate-shaped members 29, 30 and 31. These members, being heated through the housing 20 by the heater 27, starts melting the ink pellet 39 quickly. The ink thus molten is sucked into the gaps D by capillary action, thus raising the ink level L. The capillary action in the nozzle orifice 22 is greater than that in the gap D. Therefore, as ink droplets are jetted, the ink 32 is gradually consumed, and the ink level L is decreased.

Since the ink pellet 39 at room temperature is supplied into the head high enough in temperature to liquefy it, the temperature of the head may be abruptly decreased. And, when the ink 32 near the pressure generating means is decreased in temperature, it is increased in viscosity thus obstructing the jetting of ink droplets. In the head of the invention, its interior is partitioned with the plate-shaped members 29, 30 and 31, and the latter, being set away from the pressure generating means in a sense of heat conduction, serve as thermal interference members. In addition, the ink pellet supplied into the head is brought into linear contact with the tops of the plate-shaped members 29, 30 and 31, and not directly put into the liquefied ink 32. Accordingly, the ink near the pressure generating means is not abruptly decreased in temperature by the ink pellet thus supplied.

It is desirable that the ink pellet 39 is small in volume to the extent that, when completely molten, it will not flow over the ink holding means. Reasons for this are that, in the reduction of temperature, because of the small volume of the ink pellet 39 the thermal capacity is small, and if the liquefied ink flows over the ink holding means, then the ink may leak out for instance when the head is set upside down.

In the above-described embodiment, the ink pellet 39 is supplied in such manner that it is brought into contact with the upper portion of the ink holding means; however, the invention is not limited thereto or thereby. That is, the head may be so designed that ink pellet is supplied in such a manner that it contacts the side or lower portion of the ink holding means, when necessary because of the structure etc. of the printer.

In the above-described embodiment, the pressure generating means employs the method of bending the cantileverd vibrators 24; however, the invention is not limited thereto or thereby. For instance, the following method may be employed: Flexible members such as piezo-electric elements are arranged adjacent to the ink holding means, thereby to generate pressure in the ink holding means; or local heat generating means is provided, so that bubbles formed by the heat generated thereby are utilized to obtain pressure high enough to jet ink droplets.

In the above-described embodiment, the ink holding means utilizes the gaps formed between the juxtaposed plate-shaped members 29, 30 and 31 and the walls of the housing 20. The ink holding means may be formed by using foamed members having a plurality of minute cavities, or a plurality of pipes small in diameter.

In supplying ink to the head, the lever may be operated by means of a drive source such as an electric motor or plunger provided at the movable section, or by utilizing an external movement such as the carriage movement.

Figure 14A:
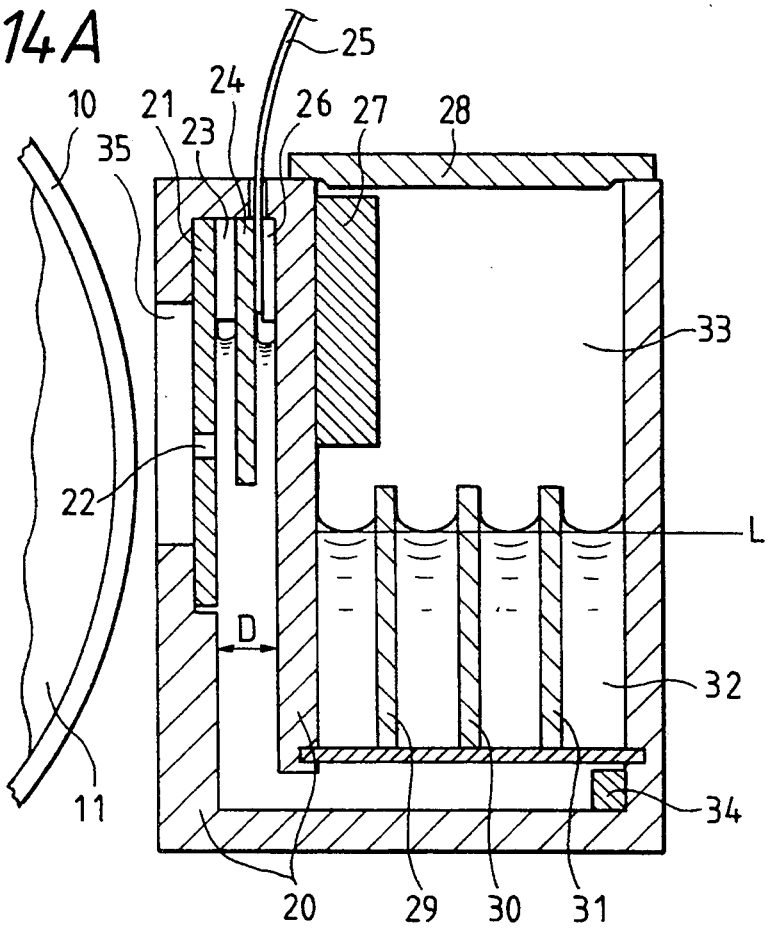
FIG. 14A is a sectional view showing an ink jet head according to a still further embodiment of the invention.

FIG. 14A illustrates a sectional view of an ink jet head according to a still further embodiment of the invention. As shown in FIG. 14A, a container-like housing 20 made of metal material such s aluminum or SUS high in thermal conduction and macromolecular material such as polysulfone, polyacetal or ABS is so positioned that an opening 35 formed in its one side is confronted with the recording sheet 10 wound on the platen 11. Held behind the opening 35 in the housing 30 are a nozzle-formed member, namely, a nozzle plate 21 having a predetermined number of nozzle orifices 22 arranged along the platen axis, a spacer 23, pressure generating means, namely, vibrators 24, electrical conductors 25, and an elastic member 26. Each of the vibrators 24 is a laminate of a piezo-electric element and a metal foil of Ni or SUS which is flexible like a bimetal plate, and it is cantilevered; more specifically, its one end together with the nozzle plate 21 and the spacer 23 is fixedly held under a predetermined pressure by the rigidity of the housing 20 and the elasticity of the elastic member 26, whereas the other end is hung free. The vibrators 24 are so positioned that the free ends thereof confront with the nozzle orifices 22 formed in the nozzle plate 21, respectively. A small gap is held between the nozzle plate 22 and the vibrators 24 by the spacer 23 with high accuracy.

In the head, ink holding means is formed by walls of the housing 20, the nozzle plate 21, and plate-shaped members 29, 30 and 31 which are arranged with gaps D of 2 mm or less therebetween, as shown in FIG. 14A. In one of the gaps D, the pressure generating members, namely, the vibrators 24 are provided. The gaps D formed by the plate-shaped members 29, 30 and 31 are made in parallel with one another by gap regulating means (not shown). Cuts are formed in the lower end portions of the plate-shaped members 29, 30 and 31 which are in contact with the bottom of the housing 20, to lead the ink 32 into the gap D2 adjacent thereto. In the head in which the level L of the ink 32 is held below the axes of the nozzle orifices 22 at all times as described later, the gaps D must be a certain value or less which is determined from head configuration, and ink physical properties and surface tension so that the leakage of the liquefied ink 32 is prevented at all times no matter what posture the head assumers. When two plates are held in the air in such a manner that they are in parallel with each other with a certain gap therebetween, and are extended in the direction of gravity, a liquid can be held stable between the two plates in a certain range of the direction of gravity, because the weight of the liquid balances with the surface tension thereof which occurs between the liquid and the surfaces of the plates which are in contact with it. Application of this principle to an ink jet head has result in the present invention. In order that the above-described principle may be applied no matter what posture the head assumes, the gap D should be set to a certain value or less which may be acceptable with the head configuration, i.e., available in the ink holding means, and with which the weight of the ink 32 balances with the surface tension thereof which occurs between the ink and a part which is in contact with the ink. In addition, the gap D should be small enough to the extent that the ink in the ink holding means is raised to the nozzle orifices 22, and the variation of the ink level is suppressed during movement of the carriage 15. Furthermore, the gap should be such that, whenever bubbles are formed in the ink during liquefaction, it can let them go, and it allows the continuous supply of ink in the ink jetting operation; that is, it permits the ink to be sufficiently supplied to the nozzles while it is being jetted at high frequency.

As shown in FIG. 14A, an ink level detecting device 34 is provided in the ink holding means. The device 34 operates to detect when the level L reaches a predetermined value or lower. When it is detected by the device 34 that the level L has reached the predetermined value or less, the cover 28 of the housing 20 is opened, so that an ink block is supplied into an ink receiving chamber 33 from a solid-phase ink container (not shown). The volume of the ink block supplied into the ink receiving chamber 33 is such that, when it is completely molten, the level L will not go above the axes of the nozzle orifices 22.

Filter means, namely, a filter 40, as shown in FIG. 14A, is disposed in such a manner that in the pressure generating means, it is in contact with the ends of the plate-shaped members 29, 30 and 31. The filter 40 is made up of a 100 μm mesh of stainless steel and "nylon" fibers and a nickel electrocast product. Especially, the flow resistance of the filter should be so determined that it will not greatly retard the flow of the ink 32 which runs from the ink receiving chamber 33 to the pressure generating means, and it can be determined by adjusting the mesh configuration and numerical aperture of the filter 40. As shown in FIG. 14A, the filter 40 is held in direction contact with the ends of the plate-shaped members 29, 30 and 31. Therefore, when the ink 32 flows from the gaps towards the pressure generating means, it can readily shift from one gap to another; that is, the ink 32 can be supplied smoothly.

Figure 14B:
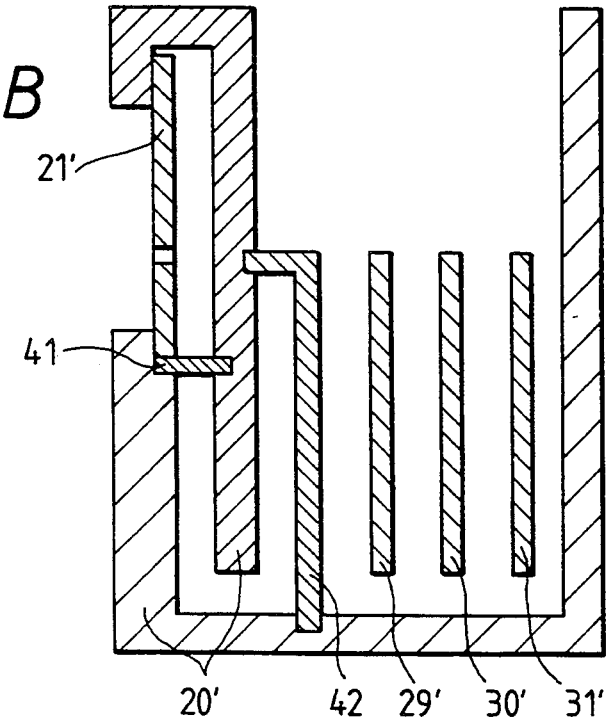
FIG. 14B is a sectional view showing an ink jet head according to a modified embodiment of FIG. 14A.

FIG. 14B is a sectional view showing a second example of the head according to the invention, which is different in the positions of the filter means from the above-described first example of the head. In FIG. 14B, for simplification in illustration, the housing 20, the plate-shaped members 29, 30 and 31, and the nozzle plate 21 of FIG. 14B are shown as they are. In the head of FIG. 14B, a filter is disposed near the pressure generating means. Since the filter 41 is located close to the pressure generating means, the head is not affected by depositions or bubbles formed in the ink. The head further comprises a second filter 42 provided as shown in FIG. 14B. The filter 42 functions also as ink holding means similarly as the plate-shaped members 29, 30 and 31. It may employ a plurality of filters 42. In this case, the filters can be large in area and in numerical aperture. Therefore, when the ink flows to the pressure generating means, the flow resistance is considerably low, and the ink holding means is improved in volumetric efficiency; that is, the ink capacity is increased.

It is desirable that the head is so designed that the capillary action attributing to the surface tension occurring with the filter means is lower than the capillary action occurring with the nozzle orifices 22. With the head thus designed, the ink held in the ink holding means can be used thoroughly. Thus, the head is high in ink consumption efficiency. Furthermore, for the same reason, the head is free from the difficulty that the remaining ink in the head is deteriorated. Thus, the head of the invention is high in reliability.

The operation of the ink jet head thus constructed will be described.

First, the ink 32 is supplied to the vicinity of the vibrators 14 and the nozzle plate 21. Under this conditions the ink is jetted in the form of ink droplets as follows: When electrical signals are applied selectively to the vibrators 24, the piezo-electric elements contract by piezo-electric effect, while the metal foils, being high in rigidity, are suppressed in dimensional change. As a result, each of the vibrators 24 is curved towards the nozzle plate 21 so that pressure is generated in the small gap between the nozzle plate 21 and the vibrator 24, thus jetting ink droplets. The head operating on the above-described ink jetting principle is free from the disadvantage that the jetting of ink is unsatisfactory being affected by bubbles as long as no bubbles exist in the ink between the nozzle plate 21 and the vibrator 24. In the above-described embodiment, the ink jet head is combined with the ink supplying device which is so designed as to let bubbles go out of the ink. Therefore, the head of the invention is considerably high in reliability, being not affected by the bubbles in the ink holding means at all.

When it is detected by an ink level detecting device 34 that the quantity of ink remaining in the head is a predetermined value or less, an ink supply request signal is outputted thereby. The ink supplied into the ink receiving chamber 33 is quickly sucked into the gap by capillary action and held there, thus raising the ink level L. The capillary action with the nozzle orifice is greater than the capillary action with the gap D. Therefore, as the ink jetting operation is carried out, the ink 32 is consumed, as a result of which the ink level L is decreased. An opening 36 is provided above the nozzle orifices 22 in such a manner that it is communicated with the air, so as to let bubbles formed near the vibrators 24 go out of the head.

It is desirable that the ink 32 is small in volume to the extent that it will not flow over the ink holding means, for instance because, if the ink flows over the ink holding means, then the ink may leak out for instance when the head is set upside down.

In the above-described embodiment, the ink is supplied to the ink holding means from above; however, the invention is not limited thereto or thereby. That is, it may be supplied to the ink holding means from side or below, if necessary because of the structure etc. of the head.

In the above-described embodiment, the ink holding means utilizes the gaps formed between the juxtaposed plate-shaped members 29, 30 and 31 and the walls of the housing 20. The ink holding means may be formed by using foamed members having a plurality of minute cavities, or a plurality of pipes small in diameter.

The operation of the head using a hot-melt ink which is in solid phase at room temperature will be described. As shown in FIG. 14A, a heat source, namely, a heater 27 is mounted on the wall of the housing 20 behind the pressure generating means. In the embodiment, only one heater 27 is used; however, it should be noted that the invention is not limited thereto or thereby. That is, a plurality of heaters may be arranged at a plurality of positions, with the thermal efficiency taken into account. The plate-shaped members 29, 30 and 31 and the gap regulating member (not shown) are thermally coupled to the housing 20, so that heat generated by the heater 27 is transmitted quickly to the ink block to melt it and maintain the molten ink at high temperature.

In the case where the head has the heater 27, it is preferable that the housing 20 is made of metal material such as aluminum or stainless steel high in heat conduction. In the embodiment, the area of the ink holding means which is in contact with an ink block is large, and the head is miniaturized. Therefore, the period of time which elapses from the time instant that the power switch is turned on until the temperature of the ink 32 reaches a predetermined value; that is, the head becomes ready for a printint operation is considerably short.

In the ink supplying operation, the solid-phase ink 32 which is held at room temperature is supplied into the head. Therefore, the ink near the pressure generating means is temporarily decreased in temperature and accordingly increased in viscosity, so that the ink may not be jetted satisfactorily. However, in the embodiment, the ink 32 is supplied first to the plate-shaped members 29, 30 and 31, and therefore the plate-shaped members 29, 30 and 31 large in thermal capacity and excellent in the conduction of heat from the heat source serve as thermal interference members, as a result of which the ink 32 near the pressure generating means is not greatly affected in temperature thereby.

In the embodiment, it is desirable that the filter 40 is made of metal, because the metal filter is high in heat conductivity, and it functions quickly when the power switch is turned on.

The hot-melt ink is greatly changed in volume when molten. Therefore, when it is used, bubbles are unavoidably formed in the ink in the ink holding means. In the embodiment, the filter 40 in the ink holding means serves as an ink trap, thus preventing the entrance of ink bubbles into the pressure generating means which otherwise may be caused as the ink 32 is consumed.

When the filter is disposed in the gap D as indicated at 41 in FIG. 14B, and is held oblique, then it can regulate the flow of ink 32 in the ink holding means; that is, the ink bubbles can be removed with the direction of flow of the ink 32 maintained unchanged. This method can provide an ink jet head in which supplying the ink 32 is achieved with high efficiency, and which is not affected by the ink bubbles in the ink holding means, and is high in reliability and excellent in ink droplet jetting characteristic.

Figure 15A:
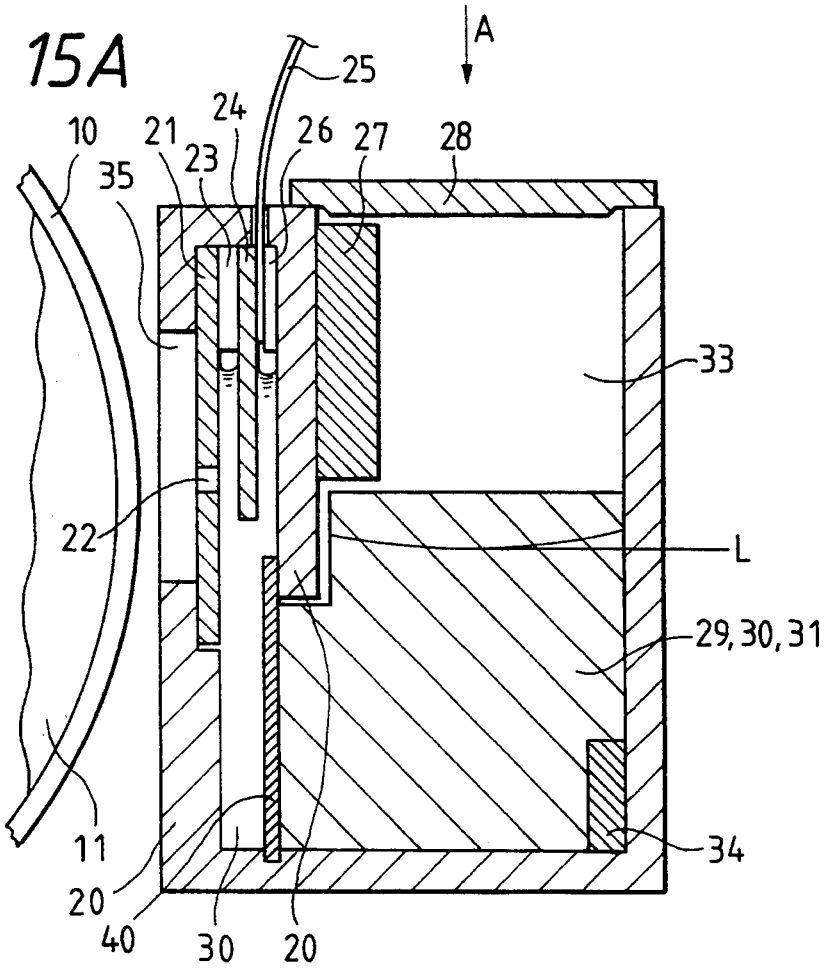
FIG. 15A is a sectional view showing an ink jet head according to a still further embodiment of the invention.

FIG. 15A is a sectional view of an ink jet head according to a still further embodiment of the invention. As shown in FIG. 15A, a container-like housing 20 made of metal material such as aluminum or SUS high and macromolecular material such s polysulfone, polyacetal or ABS is so positioned that an opening 35 formed in its one side is confronted with the recording sheet 10 wound on the platen 11. Held behind the opening 35 in the housing 20 are a nozzle-formed member, namely, a nozzle plate 21 having a predetermined number of nozzle orifices 22 arranged along the plate axis, a spacer 23, pressure generating means, namely, vibrators 24, electrical conductors 25, and an elastic member 26. Each of the vibrators 24 is a laminate of a piezo-electric element and a metal foil of Ni or SUS which is flexible like a bimetal plate, and it is cantilevered; more specifically, its one end together with the nozzle plate 21 and the spacer 23 is fixedly held under a predetermined pressure by the rigidity of the housing 20 and the elasticity of the elastic member 26, whereas the other end is hung free. The vibrators 24 are so positioned that the free ends thereof confront with the nozzle orifices 22 formed in the nozzle plate 21, respectively. A small gap is held between the nozzle plate 22 and the vibrators 24 by the spacer 23 with high accuracy.

Figure 15B:
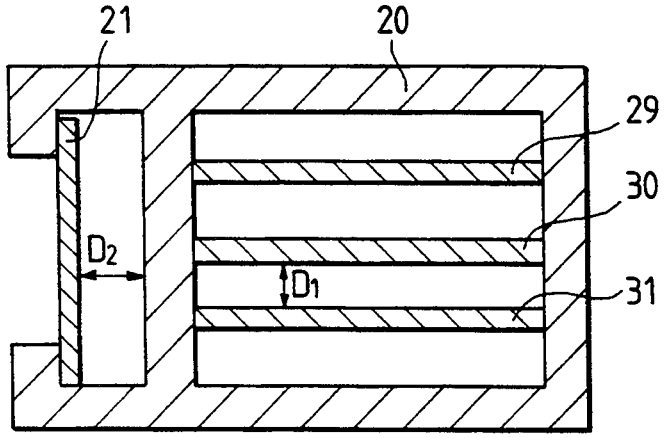
FIG. 15B is a sectional view taken in the direction of the arrow A in FIG. 15A.

FIG. 15B is a sectional diagram, as viewed in the direction of the arrow A in FIG. 15A, showing the ink holding means in detail. For simplification in illustration, only the housing 20, nozzle plate 21 and plate-shaped members 29, 30 and 31, are shown in FIG. 15B. As is apparent from FIG. 15B, the ink holding means is made up of first plate-shaped members, namely, the above-described plate-shaped members 29, 30 and 31, second plate-shaped members, namely, walls of the housing 20, and the nozzle plate 21 in such a manner that the plate-shaped members 29, 30 and 31 and two walls of the housing 20 are arranged with a gap D1 therebetween, and the nozzle plate 21 and one wall of the housing 20 are arranged with a gap D2 therebetween, the gaps D1 and D2 being no more than 2 mm. The gaps D1 and D2 are substantially perpendicular to each other, and are communicated with each other through a communicating passageway which is an opening formed in the lower portion of the housing 20 as viewed in the direction of gravity. A first reason why the communication passage way is located in the lower portion of the housing is that, in initially supplying ink to the ink holding means, the water head of the ink 32 in the gaps D1 can be utilized to send the ink 32 in the gap D2. A second reason is that the ink held between the plate-shaped members 29, 30 and 31 can be used in its entirety. In connection with these reasons, it is desirable that the gap D2 is smaller than the gaps D1 (as described later). The pressure generating means, namely, the vibrators 24 are provided in a part of the gap D2 between the wall of the housing 20 and the nozzle plate 21. A gap regulating members (not shown) is provided to arrange the gaps D1 formed by the plate-shaped members 29, 30 and 31 in such a manner that those gaps are substantially in parallel with one another and they are extended vertical, i.e., substantially perpendicular to the direction of scanning of the carriage on which the head is mounted. The head is so designed that the level L of the ink 32 is held below the axes of the nozzle orifices 22 at all times (as described later in more detail). The gaps D1 and D2 should be set to the values or less which are determined from the head configuration and the ink physical properties and surface tension so that, no matter what posture the head thus designed assumes, the leakage of the liquefied ink 32 is prevented. When two plates are held in the air in such a manner that they are in parallel with each other and are extended in the direction of gravity, a liquid is stably held therebetween at a certain height in the direction of gravity, because between the plates, the weight of the liquid balances with the surface tension thereof. Application of this principle to the ink jet head has resulted in the present invention. In order that, no matter what posture the head assumed, the above-described principle is applicable, the gaps D1 and D2 should be set to the values or less which is available in the head; i.e., in the ink holding means, and with which the weight of the ink 32 balances with its surface tension occurring with a member which is in contact with the ink. It is necessary to make the gap D2 smaller than the gaps D1 so that the ink in the ink holding means is led above the nozzle orifices 22. The fact that the gap D2 is smaller than the gaps D1 means that a capillary action with the gap D2 is greater than that with the gap D1. Therefore, the ink in the gaps D1 can be stably supplied to the pressure generating means in the gap D2. The gaps D1 and D2 must be small enough to suppress the variation of the ink level during movement of the carriage 15. In addition, the gaps D1 and D2 should be such that bubbles are released when formed in the ink, the ink is supplied continuously to the nozzles even when jetted continuously, or the ink is supplied sufficiently to the nozzles even when jetted at high frequency.

An ink level detecting device 34 is provided in the ink holding means. When the device 34 detects that the level L is a predetermined value or less, a cover 28 closing the top of the container-shaped housing 20 is opened, and the ink is supplied from an ink container (not shown) into an ink receiving chamber 33. The volume of the ink thus supplied is such that the level L is held below the axes of the nozzle orifice.

In the above-described embodiment, the second plate-shaped members are the wall of the housing 20 and the nozzle plate 21. In another embodiment, the second plate-shaped members may be of a plurality of plate-shaped members which are stacked. In this case also, the gaps D1 and D2 should be set to the predetermined value or less which is available in the head; i.e., in the ink holding means, and with which the weight of the ink 32 balances with the surface tension occurring with the plate-shaped members.

The operation of the ink jet head thus constructed will be described.

First, the ink 32 is supplied to the vicinity of the vibrators 14 and the nozzle plate 21. Under this condition, the ink is jetted in the form of ink droplets as follows: When electrical signals are applied selectively to the vibrators 24, the piezo-electric elements contract by piezo-electric effect, while the metal foils, being high in rigidity, are suppressed in dimensional change. As a result, each of the vibrators 24 is curved towards the nozzle plate 21 so that pressure is generated in the small gap between the nozzle plate 21 and the vibrator 24, thus jetting ink droplets. The head operating on the above-described ink jetting principle is free from the disadvantage that the jetting of ink is unsatisfactory being affected by bubbles as long as no bubbles exist in the ink between the nozzle plate 21 and the vibrator 24. In the above-described embodiment, the ink jet head is combined with the ink supplying device which is so designed as to let bubbles go out of the ink. Therefore, the head of the invention is considerably high in reliability, being not affected by the bubbles in the ink holding means at all.

When the ink level detecting device 34 detects that the quantity of ink remaining in the head is a predetermined value or less, the ink supply request signal is outputted. The ink supplied into the ink receiving chamber 33 is quickly sucked into the gaps D1 by capillary action. The capillary action with the nozzle orifice is greater than that with the gap D1. Therefore, as the ink jetting operation is carried out, the ink 32 is consumed, as a result of which the ink level L is decreased.

It is desirable that the ink 32 is small in volume to the extent that it will no flow over the ink holding means, for instance because, if the ink flows over the ink holding means, then the ink may leak out for instance when the head is set upside down.

In the above-described embodiment, the ink is supplied to the ink holding means from above; however, the invention is not limited thereto or thereby. That is, it may be supplied to the ink holding means from side or below if necessary because of the structure etc. of the ink jet type printer.

Furthermore, in the above-described embodiment, the pressure generating means employs the method of bending the cantilevered vibrators 24; however, the invention is not limited thereto or thereby. For instance, the following method may be employed: Flexible members such as piezo-electric elements are arranged adjacent to the ink holding means, to generate pressure in the ink holding means; or local heat generating means is provided so that bubbles formed by the heat geranted thereby are utilized to obtain pressure high enough to jet ink droplets.

As shown in FIG. 15A, a filter 40 is provided between the first and second plate-shaped members. The filter 40 is made up of a 100 μm mesh of stainless steel and "nylon" fibers and a nickel electrocast product. The filter 40 together with the housing 20 and the nozzle plate 21 defines the gap D2. The filter 40 is in contact with the ends of the plate-shaped members 29, 30 and 31, allowing the ink 32 to smoothly flow from the gaps D1 to the gap D2. The provision of the filter improves the function of the gap D2 as the ink holding means, and in addition, eliminates the difficulty that, in initially supplying the ink to the ink holding means, it is difficult for the ink to flow over to the gaps D2 because of the surface tension of the ink which occurs at the border line between the gaps D1 and D2. Thus, with the ink jet head according to the invention, the ink is supplied stably; that is, the ink jet head of the invention is high in reliability. In addition, the provision of the filter 40 can prevent the entrance of not only foreign matter such as dust but also bubbles into the pressure generating means and the nozzle orifices 22.

The operation of the head using a hot-melt ink which is in solid phase at room temperature will be described. As shown in FIG. 15A, a heat source, namely, a heater 27 is mounted on the wall of the housing 20 behind the pressure generating means. In the embodiment, only one heater 27 is used; however, it should be noted that the invention is not limited thereto or thereby. That is, a plurality of heaters may be arranged at a plurality of positions, with the thermal efficiency taken into account. The plate-shaped members 29, 30 and 31 and the gap regulating member (not shown) are thermally coupled to the housing 20, so that heat generated by the heater 27 is transmitted quickly to the ink block to melt it and maintain the molten ink at high temperature.

In the case where the head uses the heater 27, it is preferable that the housing 20 is made of metal material such as aluminum or stainless steel high in heat conductivity. In the embodiment, the area of the ink holding means which is in contact with an ink block is large, and the head is miniaturized. Therefore, the time interval which elapses from the time instant that the power switch is turned on until the temperature of the ink 32 reaches a predetermined value; that is, the head becomes ready for a printing operation is considerably short.

In the ink supplying operation, the solid-phase ink 32 which is held at room temperature is supplied into the head. Therefore, the ink near the pressure generating means is temporarily decreased in temperature and accordingly increased in viscosity, so that the ink may not be jetted satisfactorily. However, in the embodiment, the ink 32 is supplied first to the plate-shaped members 29, 30 and 31, and therefore the latter large in thermal capacity and excellent in the conduction of heat from the heat source serve as thermal interference members, as a result of which the ink 32 near the pressure generating means is not greatly affected in temperature thereby.

In the above-described embodiment in which the first and second plate-shaped members are held perpendicular to each other, the first plate-shaped members, namely, the plate-shaped members 29, 30 and 31 are all communicated with the gaps D2 formed by the second plate-shaped members. Therefore, when the ink 32 is caused to flow by the ink jetting operation, the flow resistance of the gaps D1 is low, and accordingly the ink 32 is sufficiently supplied to the gap D2.

With the head of the invention in which the hot-melt ink is high in viscosity immediately after molten, and it is liquefied gradually beginning with its portion closer to the pressuring means, the ink jetting operation can be started even when the ink 32 in the ink holding means remote from the pressure generating means is still high in viscosity, having been just molten. That is, the ink 32 high in viscosity in the gaps D1 is movable because the flow resistance is low.

It is preferable that, in the embodiment, the filter 40 is made of metal, because the metal filter is high in heat conductivity, and it functions quickly when the power switch is turned on.

Figure 16:
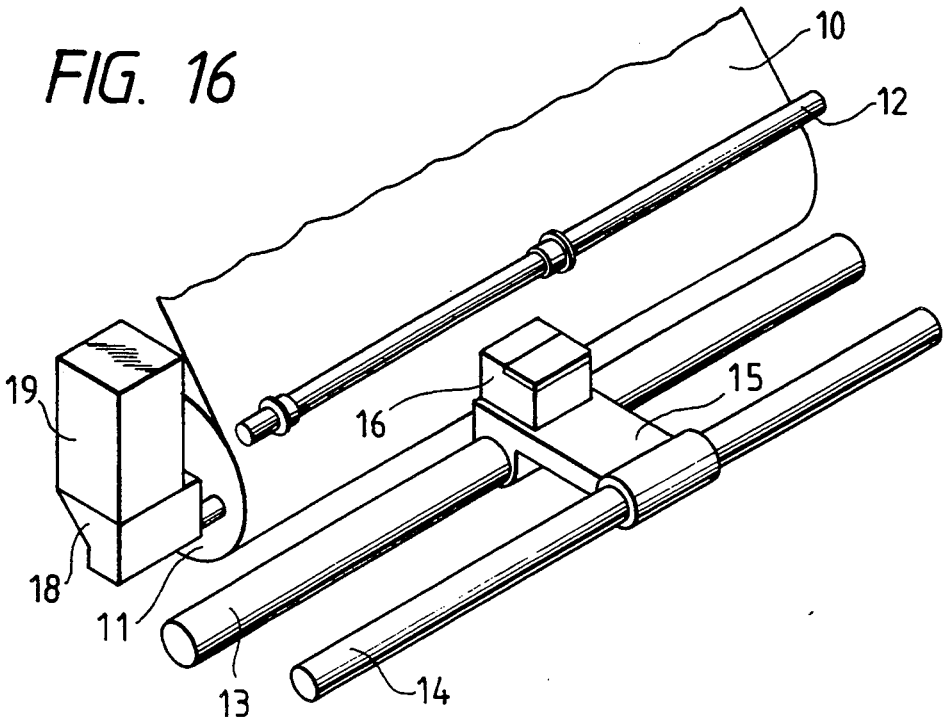
FIG. 16 is a perspective view of an ink jet type printer used for the ink jet head shown in FIGS. 11 through 15B.

FIG. 16 illustrates a printer to which the ink jet head as shown in FIGS. 11, 13, 14A, 14B, 15A and 15B is attached. Like reference numerals shown in FIG. 16 designate corresponding parts in FIGS. 4 and 7. Accordingly, the explanation of the operation of the printer in FIG. 16 is omitted.

As was described above, in the method of the invention, the solid-phase ink blocks in the form of a bar are supplied into the ink pooling chamber as it is. Therefore, the quantity of ink supplied is constant being free from the ambient temperature. Furthermore, the time required for supplying the ink block can be set considerably short. In addition, it is not always necessary to mount the ink supplying device on the carriage, which allows reduction of the weight of the carriage.

In the ink supplying device, the ink is not liquefied, which eliminates the difficulty that resolidification of the ink obstructs the operation of the ink supplying mechanism; that is, the ink can be supplied positively. Furthermore, the solid-phase ink blocks in the form of a bar are used one by one after being broken. Therefore, the difficulties that the ink particles or ink pellets are joined together by heating are eliminated, and the ink container is improved in volumetric efficiency.

As was described above, according to the invention, the quantity of ink in the head may be small, and therefore the head and the carriage can be miniaturized as much. Accordingly, the amount of heat required for melting the ink in the head is reduced as much; that is, the pause period is reduced. Since the carriage is small in size, it can be moved readily, and the printer can be simplified and miniaturized as much.

The ink is consumed quickly after molten, and therefore the ink in the head is maintained unchanged in characteristic. Furthermore, the liquefied ink is held in the small gap in the head, it is prevented from being affected by the acceleration or deceleration of the carriage, or by the change in posture of the ink supplying device; that is, it is free from the difficulties that it is shifted, its surface is ruffled, or bubbles are formed in it. This will ensure the stable operation of the head.

As was described above, in the ink jet head using the ink which changes in physical phase, according to the invention the walls in contact with the ink are so designed as to generate heat immediately, whereby the time of preheating ink can be greatly reduced. Furthermore, the ink chamber and the ink supplying path can be made into one unit by using the heat generating member, and therefore the number of components forming the ink jet head can be reduced as much. Thus, an ink jet head low in manufacturing cost and small in size can be provided according to the invention.

As was described above, according to the invention, the quantity of ink in the head may be small, and therefore the head and the carriage can be miniaturized as much. Accordingly, the amount of heat required for melting the ink in the head is reduced as much; that is, the pause period is reduced. Since the carriage can be smaller in size, it can be moved with ease, and the printer can be simplified and miniaturized as much.

The ink is consumed quickly after molten, and therefore the ink in the head is maintained unchanged in characteristic.

Furthermore, in the head of the invention, the distance between the filter means and the pressure generating means is short, and therefore the probability is high that, after being removed by the filter, ink bubbles or deposits are newly formed. Thus, the ink jet head of the invention is high in reliability. In addition, in the head of the invention, the filter means is provided in the ink holding means, and therefore, no matter what posture the head assumes, the ink is passed through the filter means before jetted in the form of ink droplets. This also contributes to the improvement of the reliability of the ink jet head of the invention.

Furthermore, the ink contained in the head is held in the narrow gaps by capillary action, and preferably the plate-shaped members are held substantially perpendicular to the direction of scanning of the carriage. Therefore, no matter what posture the head assumes, no ink leaks out of it. That is, the head of the invention is high both in reliability and in security. Furthermore, the ink in the head is prevented from being affected by the acceleration or deceleration of the carriage or by the change in posture of the ink supplying device; that is, the head of the invention is free from the difficulties that the ink in the head is shifted, its surface is ruffled, or bubbles are formed in it.

In the head of the invention, almost all the plate-shaped members are held substantially perpendicular to the gap formed by the second plate-shaped members, and therefore the flow resistance provided thereby is low. Thus, the head of the invention is substantially free from the pressure variation which may be caused when the ink is supplied thereto, thus allowing the stably ink supplying operation. That is, the ink jet head according to the invention is high in reliability and in operability.

What is claimed is:

1. An ink jet recording apparatus comprising:

a carriage which moves over a recording medium in a scanning manner;

an ink supplying device having an ink container in which solid-phase ink is put, an ink measuring section and a first heater, said ink supplying device being arranged at a predetermined position and said ink container being rotatably supported, said ink supplying device including a plurality of plates with gaps therebetween; and an ink jet head having a plurality of nozzles for jetting ink droplets therethrough, said ink jet head having a second heater and being mounted on said carriage, said ink jet head receiving ink from said ink supplying device, said ink being liquefied in said ink container by said first heater and then moved to said ink jet head via capillary action in the gaps between said plates and kept liquefied by said second heater.

2. An ink jet recording apparatus a claimed in claim 1, wherein when said ink jet head is moved to said predetermined position, said liquefied ink is supplied from said ink supplying device to said ink jet head.

3. A method of supplying ink to an ink jet head in an ink jet recording apparatus comprising the steps of:

putting solid-phase ink into a rotatably supported ink container of an ink supplying device, said ink supplying device having a first heater and arranged at a predetermined position;

supplying a predetermined quantity of said solid-phase ink from said ink container to an ink measuring section by swinging said ink container;

supplying said solid-phase ink from said ink measuring section to said first heater;

heating a portion of said solid-phase ink located in said ink container of said ink supplying device, thus liquefying said portion of solid-phase ink;

supplying a predetermined quantity of said liquefied ink to said ink jet head via capillary action when the quantity of ink in said ink-jet head becomes less than a predetermined value;

jetting ink droplets through a plurality of nozzles in said ink jet head, said ink jet head being mounted on a carriage which moves in a scanning manner over a recording medium; and maintaining said ink in said ink jet head in a liquid phase by a second heater.

4. A method as claimed in claim 3, further comprising the step of moving said ink jet head to said predetermined position when supplying said liquefied ink to said ink jet head.

5. An ink jet recording apparatus comprising:

an ink container for containing solid-phase ink;

an ink jet head having a plurality of nozzles and a plurality of pressure generating members opposed to said nozzles for jetting ink droplets through said plurality of nozzles;

an isolating member disposed on a side opposite said nozzles with respect to said pressure generating members for isolating said ink jet head;

a first heater for liquefying said solid-phase ink;

ink supplying means for supplying said solid-phase ink from said ink container to said ink jet head by the weight of the solid-phase ink itself to be brought into contact with said isolating member, said ink supplying means including a plurality of plate shaped members having gaps therebetween, the melted ink in the ink container moving via capillary action through said gaps so as to move to said ink jet head;

a second heater for heating and maintaining said liquefied ink in liquid form, said second heater disposed in said ink jet head; and a carriage on which said ink jet head is mounted, said carriage being movable over a recording medium in a scanning manner.

6. An ink jet recording method comprising the steps of:

putting solid-phase ink into an ink container;

supplying said solid-phase ink close to nozzles of an ink jet head by moving the ink via capillary action and the weight of solid-phase ink itself, said ink jet head having a heater and being mounted on a carriage which moves over a recording medium in a scanning manner;

liquefying said solid-phase ink using said heater in said ink jet head;

maintaining said ink in liquid form using a second heater in said ink jet head; and jetting said liquefied ink through said nozzles of said ink jet head.

7. An ink jet recording method for an ink jet head comprising the steps of:

supplying the ink which is solid in phase at room temperature so that said ink is brought into direct contact with an ink holding means including a plurality of plate-shaped members arranged upright within a housing made of a material having a high coefficient of thermal heat conductivity, said housing including a first heat source, said plate-shaped members having a high coefficient of thermal heat conductivity and upper ends of said plate-shaped members being exposed from the ink liquid surface;

transmitting heat generated by said first heat source via said ink holding means;

using said transmitted heat to melt said solid-phase ink;

sucking said molten ink into said ink holding means by capillary action;

maintaining said molten ink in a liquid form in said ink jet head via a second heater; and jetting said molten ink which is close to a nozzle orifice in the form of ink droplets by a pressure generating member arranged within said ink holding means.

jetting said molten ink which is close to a nozzle orifice in the form of ink droplets by a pressure generating member arranged within said ink holding means.

8. An ink jet head comprising:

a housing made of a material having a high coefficient of thermal conductivity, said housing including a first heat source, and being arranged so as to confront a recording medium;

ink holding means including a plurality of plate-shaped members arranged upright inside said housing and having minute, adjustable gaps that provide capillary action, said plate-shaped members having a high coefficient of thermal heat conductivity, the upper ends of said plate shaped members being exposed from a liquid surface of the ink, said ink holding means transmitting heat generated by said first heat source to melt a solid-phase ink put into said housing;

a nozzle formed member having at least one nozzle orifice disposed so as to confront said recording medium;

a second heat source for maintaining said molten ink in a liquefied form; and pressure generating means with said ink holding means with a minute gap from said nozzle formed member for generating a pressure which causes ink near said nozzle orifice to jet in the form of ink drops.

9. A ink jet head as claimed in claim 8, wherein said ink holding means comprises first plate means having a plurality of plate-shaped members stacked with minute gaps D1 therebetween.

10. An ink jet head as claimed in claim 8, further comprising filter means arranged in said ink holding means.

11. An ink jet head as claimed in claim 9, wherein a minute gap D2 is formed between said nozzle formed member and a part of said housing, said minute gap D2 is smaller than said gaps D1 formed between said plurality of plate-shaped members.

12. An ink jet head as claimed in claim 10, wherein capillary action between said nozzle orifice and said molten ink is greater than capillary action between said filter means and said molten ink.

13. An ink jet head as claimed in claim 9, further comprising second plate means disposed substantially perpendicular to said first plate means.

14. An ink jet head as claimed in claim 13 wherein said first plate means are arranged to be substantially perpendicular to the direction of scanning of a carriage.

15. An ink jet head as claimed in claim 13, wherein said second plate means includes a part of said housing.

16. An ink jet head as claimed in claim 13, further comprising filter means provided at the intersection of said first and second plate means.

17. An ink jet head as claimed in claim 10, wherein said filter means is made of heat conductive material.

18. An ink jet head as claimed in claim 16, wherein said filter means is made of heat conductive material.

19. An ink jet head as claimed in claim 9, wherein said plate-shaped members are provided with cuts which are formed in the lower end portions thereof to lead the ink into said minute gaps adjacent thereto.

20. A solid-phase bar of ink for use in an ink jet printing apparatus, said bar of ink comprising:

a plurality of blocks of ink joined together to form said bar, wherein each of said blocks is joined to the remaining blocks so that each of said blocks is easily separable from the bar of ink, and said bar of ink is rigid in a longitudinal direction and in a widthwise and a heightwise direction.

21. A solid-phase bar of ink as claimed in claim 20, wherein each of said plurality of blocks is the same size.

22. A solid-phase bar of ink as claimed in claim 20, further comprising grooves formed in the bar between each of said plurality of blocks so that said blocks are easily broken from the bar of ink.

23. An ink jet recording method comprising the steps of:

providing an ink jet head operatively coupled to an ink supply device for supplying a solid-phase ink, said ink being in solid phase at room temperature and having a curved surface, providing an ink container for supplying ink to an ink jet head via the weight of said ink in cooperation with movement of a lever, said ink jet head including a housing made of a material having a high coefficient of thermal conductivity, a heat source, and a plurality of vertical plate-shaped members made of a material having a high coefficient of thermal conductivity and being disposed in said housing, supplying said solid-phase ink contained in said ink container into said housing of said ink jet head so as to bring said solid-phase ink into contact with said vertical plate-shaped members, melting said solid-phase ink by transmitting heat through said vertical plate-shaped members from said heat source, and supplying said molten ink to an ink jetting member.

24. An ink jet head as claimed in claim 8, further comprising detector means provided in said housing for detecting the quantity of ink remaining in said housing.

* * * * *